US010530052B2

(12) United States Patent
Sudo et al.

(10) Patent No.: US 10,530,052 B2
(45) Date of Patent: Jan. 7, 2020

(54) MULTI-ANTENNA MODULE AND MOBILE TERMINAL

(71) Applicant: Murata Manufacturing Co., Ltd., Kyoto (JP)

(72) Inventors: Kaoru Sudo, Kyoto (JP); Yasuhisa Yamamoto, Kyoto (JP); Satoshi Tanaka, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 16/038,464

(22) Filed: Jul. 18, 2018

(65) Prior Publication Data

US 2019/0123441 A1 Apr. 25, 2019

(30) Foreign Application Priority Data

Oct. 23, 2017 (JP) ..... 2017-204233
Apr. 4, 2018 (JP) ..... 2018-072249

(51) Int. Cl.

| | |
|---|---|
| ***H01Q 1/24*** | (2006.01) |
| ***H01Q 3/26*** | (2006.01) |
| ***H01Q 5/35*** | (2015.01) |
| ***H01Q 5/50*** | (2015.01) |

(52) U.S. Cl.
CPC ..... *H01Q 3/2635* (2013.01); *H01Q 3/2617* (2013.01); *H01Q 5/35* (2015.01); *H01Q 5/50* (2015.01); *H01Q 1/241* (2013.01)

(58) Field of Classification Search
CPC ..... H01Q 3/2635; H01Q 5/35; H01Q 5/42; H01Q 5/50; H01Q 1/243; H01Q 1/521; H01Q 3/2617; H01Q 1/241
See application file for complete search history.

(56) References Cited

U.S. PATENT DOCUMENTS

| | | | | |
|---|---|---|---|---|
| 2008/0088510 | A1 | 4/2008 | Murata et al. | |
| 2012/0162025 | A1* | 6/2012 | Ohno | H01Q 1/243 343/702 |
| 2015/0311589 | A1* | 10/2015 | Yokoyama | H01Q 5/35 343/722 |

FOREIGN PATENT DOCUMENTS

| | | | |
|---|---|---|---|
| JP | 2007-037077 | A | 2/2007 |
| JP | 2012-134950 | A | 7/2012 |
| WO | 2014/097846 | A1 | 6/2014 |
| WO | 2017/068885 | A1 | 4/2017 |

* cited by examiner

*Primary Examiner* — Dameon E Levi
*Assistant Examiner* — David E Lotter
(74) *Attorney, Agent, or Firm* — Pearne & Gordon LLP

(57) ABSTRACT

A multi-antenna module includes, on or in the dielectric substrate, a first radiation element, a second radiation element that operates at a frequency band lower than that of the first radiation element, and a ground plane. A first feed line and a second feed line are provided on or in the dielectric substrate. A first switch element switches between a first state in which a signal is supplied to the second radiation element and a second state including at least one of a state in which the second radiation element is connected to the ground plane with terminal impedance interposed therebetween, a state in which the second radiation element is in a floating state with respect to the second feed line and the ground plane, and a state in which the second radiation element is short-circuited to the ground plane.

15 Claims, 25 Drawing Sheets

MULTI-ANTENNA MODULE AND MOBILE TERMINAL

This application claims priority from Japanese Patent Application No. 2018-072249, filed on Apr. 4, 2018, and Japanese Patent Application No. 2017-204233, filed on Oct. 23, 2017. The contents of these applications are incorporated herein by reference in their entireties.

BACKGROUND

The present disclosure relates to a multi-antenna module and a mobile terminal in which the multi-antenna module is installed. International Publication No. 2014/097846 discloses a multiband antenna in which two kinds of antennas: a high-frequency antenna (a 60-GHz band antenna) and a low-frequency antenna (a 2.4-GHz band Wireless Fidelity (WiFi) antenna) are provided.

In mobile terminals supporting fifth-generation mobile communication systems, the fifth-generation mobile communication systems and fourth-generation mobile communication systems are concurrently used. In the fifth-generation mobile communication systems, beam forming is required to be fine-tuned depending on the communication state. It is difficult to fine-tune the beam forming in the multiband antenna disclosed in International Publication No. 2014/097846.

BRIEF SUMMARY

Accordingly, the present disclosure provides a multi-antenna module that includes a high-frequency band antenna and a low-frequency band antenna and that is capable of fine tuning the beam forming and a mobile terminal in which the multi-antenna module is installed.

According to an embodiment of the present disclosure, a multi-antenna module includes a dielectric substrate; a first radiation element provided on or in the dielectric substrate; a second radiation element that is provided on or in the dielectric substrate and that operates at a frequency band lower than that of the first radiation element; a ground plane provided on or in the dielectric substrate; a first feed line that is provided on or in the dielectric substrate and that supplies power to the first radiation element; a second feed line that is provided on or in the dielectric substrate and that supplies power to the second radiation element; and a first switch element that switches between a first state in which a signal is supplied to the second radiation element through the second feed line and a second state including at least one of a state in which the second radiation element is connected to the ground plane with terminal impedance interposed therebetween, a state in which the second radiation element is in a floating state with respect to the second feed line and the ground plane, and a state in which the second radiation element is short-circuited to the ground plane.

According to another embodiment of the present disclosure, a mobile terminal includes an image display panel and a first multi-antenna module arranged at a position overlapped with the image display panel. The first multi-antenna module includes a dielectric substrate, a first radiation element provided on or in the dielectric substrate, a second radiation element that is provided on or in the dielectric substrate and that operates at a frequency band lower than that of the first radiation element, a ground plane provided on or in the dielectric substrate, a first feed line that is provided on or in the dielectric substrate and that supplies power to the first radiation element, a second feed line that is provided on or in the dielectric substrate and that supplies power to the second radiation element, and a first switch element that switches between a first state in which the second radiation element is connected to the second feed line and a second state including at least one of a state in which the second radiation element is connected to the ground plane with terminal impedance interposed therebetween, a state in which the second radiation element is in a floating state with respect to the second feed line and the ground plane, and a state in which the second radiation element is short-circuited to the ground plane.

Setting the second radiation element to the second state using the first switch element causes directional characteristics of the first radiation element to be affected by the second radiation element. This enables the beam forming of the first radiation element to be fine-tuned.

Other features, elements, characteristics and advantages of the present disclosure will become more apparent from the following detailed description of embodiments of the present disclosure with reference to the attached drawings.

DETAILED DESCRIPTION

First Embodiment

A multi-antenna module according to a first embodiment will now be described with reference to FIG. 1A to FIG. 5B.

Figure 1A:
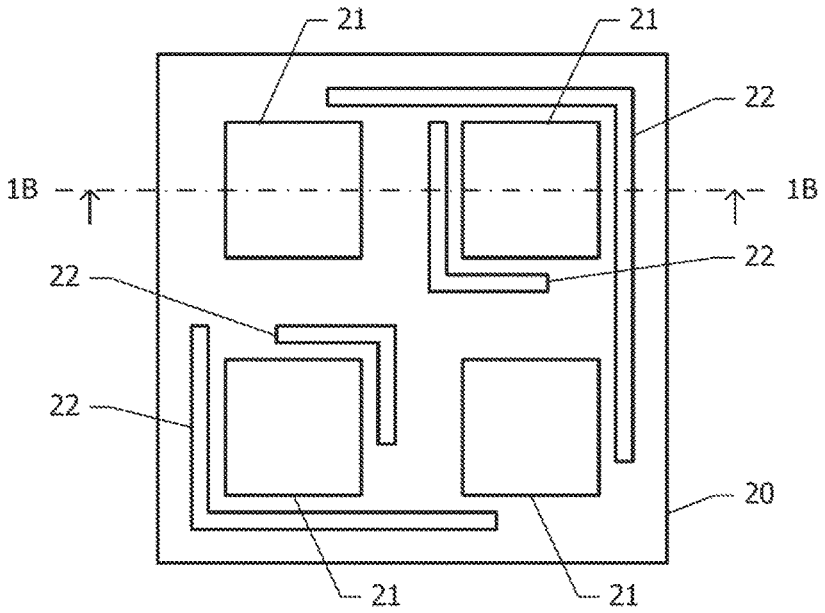
FIG. 1A is a plan view of a multi-antenna module according to a first embodiment and FIG. 1B is a cross-sectional view along an alternate long and short dash line 1B-1B in FIG. 1A.

FIG. 1A is a plan view of the multi-antenna module according to the first embodiment. Referring to FIG. 1A, multiple first radiation elements 21 and multiple second radiation elements 22 are arranged on a top face (a first face) of a dielectric substrate 20. An example is illustrated in FIG. 1A in which four first radiation elements 21 and four second radiation elements 22 are arranged. The dielectric substrate 20 may be made of, for example, glass epoxy (FR4), low temperature co-fired ceramics (LTCC), fluorine resin, or liquid crystal polymer.

The first radiation elements 21 are each composed of a conductor plate having a substantially square or rectangular planar shape. The four first radiation elements 21 are arranged in a 2×2 matrix to compose a two-dimensional array antenna. The first radiation elements 21 are designed so as to operate in a high-frequency band, for example, in a quasi-millimeter-wave band (not lower than about 20 GHz and not higher than about 30 GHz) or a millimeter-wave band (not lower than about 30 GHz and not higher than about 300 GHz), among the frequency bands used in, for example, the fifth-generation mobile communication systems.

Each of the second radiation elements 22 composes, for example, an inverted-F antenna, a monopole antenna, or a dipole antenna. The second radiation elements 22 are arranged between the multiple first radiation elements 21 and outside the area where the multiple first radiation elements 21 are arranged in a matrix. Each of the second radiation elements 22 has, for example, a substantially L-shaped or linear planar shape. The second radiation elements 22 are designed so as to operate in a frequency band used in third-generation mobile communication systems and the fourth-generation mobile communication systems (for example, a 800 MHz band, a 1.9-GHz band, or a 2.4-GHz band) and a low frequency band used in the fifth-generation mobile communication systems (for example, a frequency band of about 6 GHz or lower).

Figure 1B:
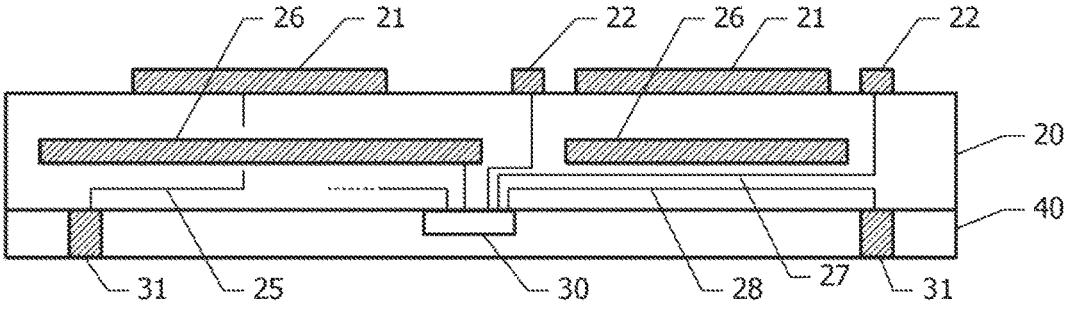

FIG. 1B is a cross-sectional view along an alternate long and short dash line 1B-1B in FIG. 1A. The first radiation elements 21 and the second radiation elements 22 are arranged on the top face of the dielectric substrate 20. A ground plane 26 is arranged on an inner layer of the dielectric substrate 20. In a plan view, the first radiation elements 21 are arranged inside the ground plane 26 and the second radiation elements 22 are arranged so as not to be substantially overlapped with the ground plane 26. The first radiation element 21 and the ground plane 26 compose a patch antenna.

A switch element 30 is mounted on a rear face (a second face) of the dielectric substrate 20 or in the dielectric substrate 20. An example is illustrated in FIG. 1B in which the switch element 30 is mounted on the rear face of the dielectric substrate 20. In addition, multiple conductor columns 31 are arranged on the rear face of the dielectric substrate 20. The second radiation elements 22 are connected to the switch element 30 through a feed line 27 arranged on or in the dielectric substrate 20 and part of the conductor columns 31 are connected to the switch element 30 through a feed line 28 arranged on or in the dielectric substrate 20. The second radiation elements 22 are connected to the conductor columns 31 via the feed line 27, the switch element 30, and the feed line 28. Another part of the conductor columns 31 is connected to the first radiation element 21 through a feed line 25 arranged on or in the dielectric substrate 20, and another part of the conductor columns 31 is connected to the ground plane 26.

The switch element 30 and the multiple conductor columns 31 are sealed with sealing resin 40. The head of each conductor column 31 is exposed to the surface of the sealing resin 40. The multi-antenna module is surface-mounted on a substrate, such as a motherboard, using the exposed head of the conductor column 31 as a connection terminal.

Figure 2:
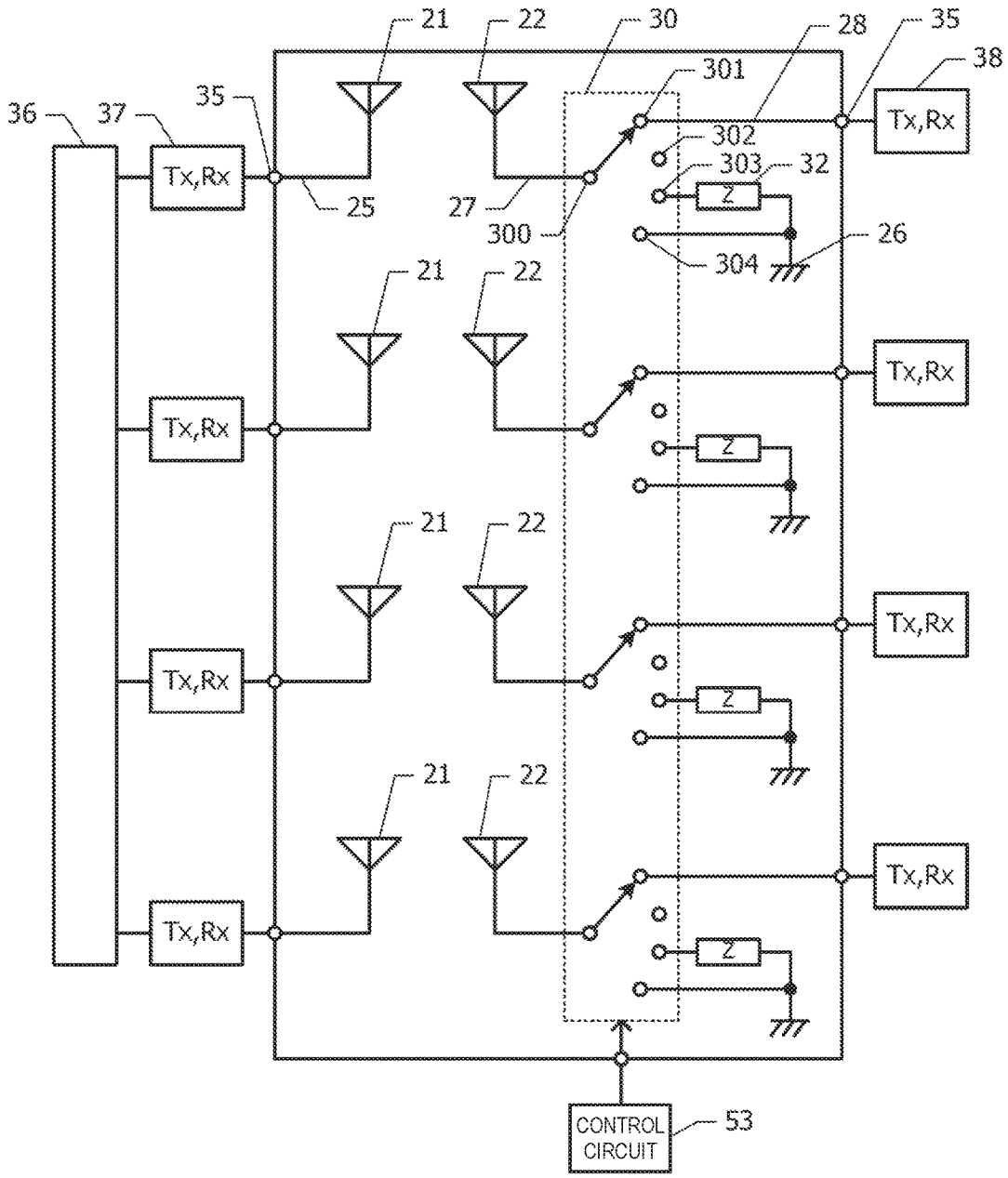
FIG. 2 is a block diagram of the multi-antenna module according to the first embodiment.

FIG. 2 is a block diagram of the multi-antenna module according to the first embodiment. Each of the multiple first radiation elements 21 is connected to the corresponding first front end circuit 37 via the corresponding connection terminal 35. The first front end circuits 37 are connected to a transmission-reception circuit 36. Each of the multiple second radiation elements 22 is connected to the switch element 30 through the corresponding feed line 27. The switch element 30 includes a single pole four throw switch provided for each second radiation element 22. For example, a complementary metal oxide semiconductor (CMOS) device may be used for the switch element 30. The switch element 30 is controlled in response to a control signal from a control circuit 53.

A common terminal 300 of the single pole four throw switch is connected to the second radiation element 22. A first terminal 301 is connected to the corresponding second front end circuit 38 via the feed line 28 and the connection terminal 35. A second terminal 302 is in a floating state in which the second terminal 302 is electrically connected to none of the ground plane 26 and the feed line 28. A third terminal 303 is connected to the ground plane 26 via terminal impedance 32. For example, impedance having fixed values of a resistance component, an inductance component, and a capacitance component may be used as the terminal impedance 32. A fourth terminal 304 is short-circuited to the ground plane 26.

Connection of the common terminal 300 to the first terminal 301 causes the second radiation element 22 to be connected to the second front end circuit 38 through the feed lines 27 and 28. Connection of the common terminal 300 to the second terminal 302 causes the second radiation element 22 to be in the floating state (in an open state for the ground). Connection of the common terminal 300 to the third terminal 303 causes the second radiation element 22 to be connected to the ground plane 26 via the terminal impedance 32 (to be terminated with the terminal impedance 32). Matching the terminal impedance 32 with input impedance of the second radiation element 22 and characteristic impedance of the feed line 27, for example, about 50Ω causes the second radiation element 22 to be in a state in which the second radiation element 22 is connected to a resistive terminator. Connection of the common terminal 300 to the fourth terminal 304 causes the second radiation element 22 in a state in which the second radiation element 22 is short-circuited to the ground (short-circuit condition).

The state in which the second radiation element 22 is floated is a state in which a feeding point of the second radiation element 22 is terminated with infinite impedance. The state in which the second radiation element 22 is short-circuited to the ground is a state in which the second radiation element 22 is terminated with zero impedance.

Advantages of the multi-antenna module according to the first embodiment will now be described.

Since the multiple patch antennas composed of the multiple first radiation elements 21 and the ground plane 26 are arranged on or in the dielectric substrate 20, the beam forming is capable of being performed. In addition, since the second radiation elements 22 operating at a frequency lower than that of the first radiation elements 21 are arranged on or in the same dielectric substrate 20, the multi-antenna module operating at multiple frequency bands is capable of being reduced in size.

When the second radiation element 22 is not operated, setting the second radiation element 22 to the open state via the switch element 30 causes the second radiation element 22 to operate as a parasitic element. At this time, a signal input into the first radiation element 21 is coupled to the second radiation element 22 and radio waves are re-radiated from the second radiation element 22. Setting the second radiation element 22 to the short-circuit condition causes the second radiation element 22 to operate as a reflection plate and the radio waves radiated from the first radiation element 21 are substantially completely reflected from the reflection plate. Terminating the second radiation element 22 with the terminal impedance 32 causes an intermediate coupling state between the short-circuit condition and the open state to vary the radiation direction of the radio waves.

Varying the electromagnetic condition of the second radiation elements 22 coupled to the first radiation elements 21 in the above manner enables the beam forming of the multiple first radiation elements 21 to be fine-tuned. This means improvement of the degree of freedom of the beam forming. For example, directional characteristics of the array antenna including the multiple first radiation elements 21 are capable of being adjusted.

Results of simulation of the directional characteristics of the multi-antenna module according to the first embodiment will now be described with reference to FIG. 3 to FIG. 5B.

Figure 3:
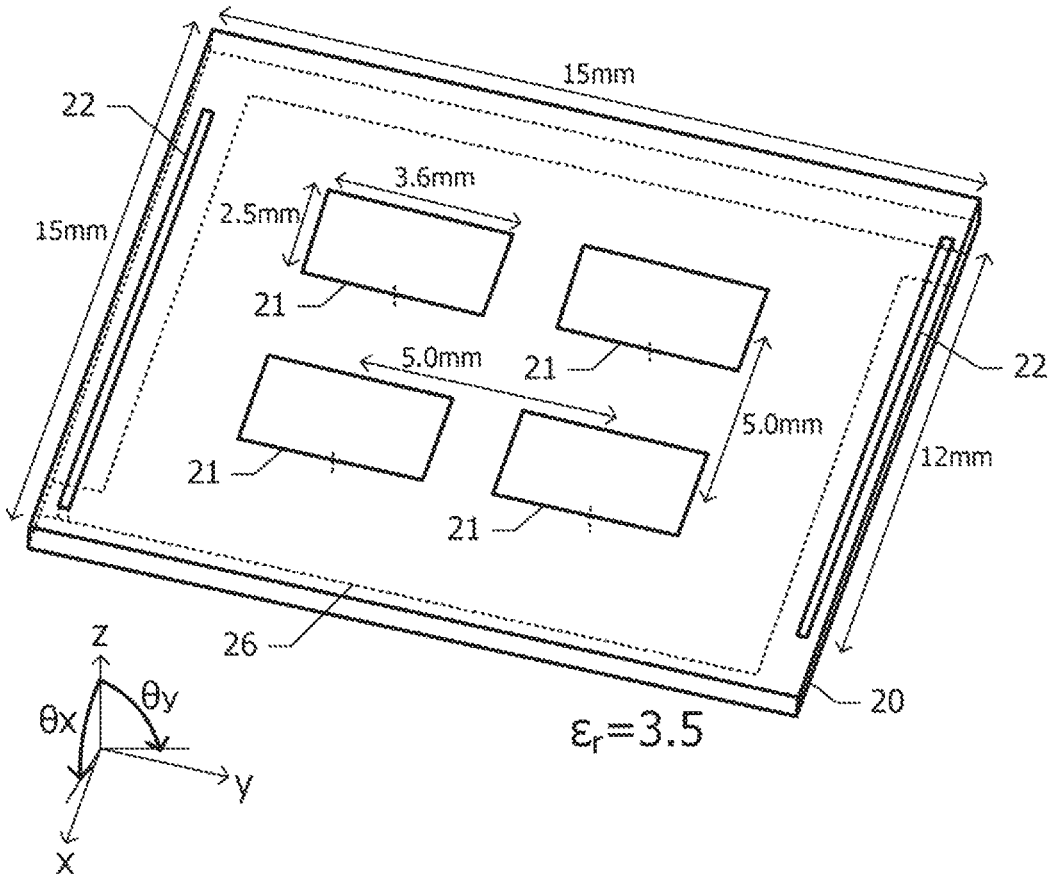
FIG. 3 is a perspective view of a multi-antenna module that was simulated.

FIG. 3 is a schematic perspective view of a multi-antenna module that was simulated. A square substrate the length of one side of which is 15 mm was used as the dielectric substrate 20. A relative permittivity εr of the dielectric substrate 20 was set to 3.5 as an example. An xyz Cartesian coordinate system was defined in which the directions of sides that are orthogonal to each other of the dielectric substrate 20 are the x axis and the y axis and the normal direction of the first face is the z axis. Four first radiation elements 21 and two second radiation elements 22 were arranged on the top face of the dielectric substrate 20. The ground plane 26 was arranged on the rear face of the dielectric substrate 20.

The four first radiation elements 21 were arranged in a 2×2 matrix in which the y-axis direction is the row direction and the x-axis direction is the column direction. Each of the first radiation elements 21 has a rectangular planar shape in which the dimension in the x-axis direction is 2.5 mm and the dimension in the y-axis direction is 3.6 mm. The distance between the centers in the x-axis direction of the first radiation elements 21 and the distance between the centers in the y-axis direction of the first radiation elements 21 were set to 5.0 mm. The feeding point of each of the first radiation elements 21 was arranged slightly on the inside of the midpoint of the side in the x-axis positive direction.

The respective second radiation elements 22 were arranged along and slightly inside the two respective sides parallel to the x axis of the top face of the dielectric substrate 20. The length of each of the second radiation element 22 was set to 12 mm. The feeding point of the second radiation element 22 arranged in the y-axis positive direction was arranged at the end portion in the x-axis negative direction, and the feeding point of the second radiation element 22 arranged in the y-axis negative direction was arranged at the end portion in the x-axis positive direction.

Each first radiation element 21 and the ground plane 26 operate as a 28-GHz patch antenna. Each of the second radiation elements 22 operates as a 4-GHz monopole antenna.

An angle from the normal direction of the top face of the dielectric substrate 20 to the y-axis positive direction was denoted by θy, and an angle from the normal direction of the top face of the dielectric substrate 20 to the x-axis positive direction was denoted by θx.

Figure 4A:
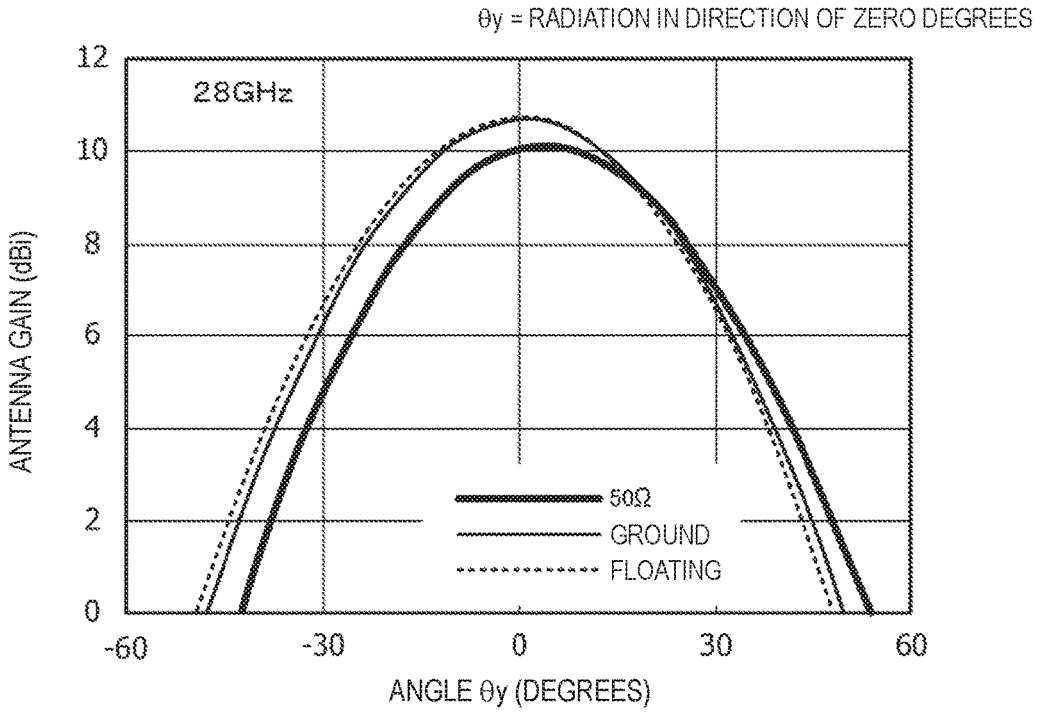
FIG. 4A is a graph illustrating a result of simulation of radiation characteristics when 28-GHz signals of the same phase were applied to four first radiation elements and FIG. 4B is a graph illustrating a result of simulation of the radiation characteristics when 28-GHz signals were applied to the four first radiation elements, the phase of the signals applied to the two first radiation elements in the y-axis positive direction advancing from the phase of the signals applied to the two first radiation elements in the y-axis negative direction by 90 degrees.
Figure 4B:
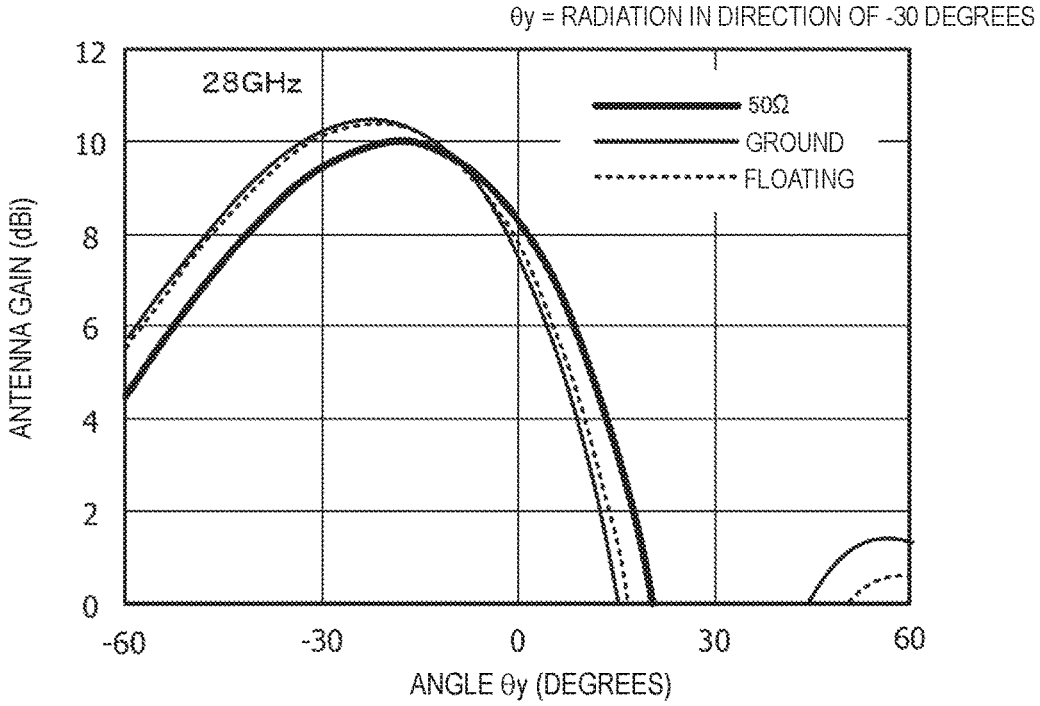

FIG. 4A is a graph illustrating a result of simulation of radiation characteristics when 28-GHz signals of the same phase were applied to the four first radiation elements 21 (FIG. 3). The graph in FIG. 4A corresponds to an example in which beams are radiated to a direction in which the angle θx and the angle θy are zero. FIG. 4B is a graph illustrating a result of simulation of the radiation characteristics when 28-GHz signals were applied to the four first radiation elements 21 (FIG. 3). The phase of the signals applied to the two first radiation elements 21 in the y-axis positive direction advances from the phase of the signals applied to the two first radiation elements 21 in the y-axis negative direction by 90 degrees. The graph in FIG. 4B corresponds to an example in which beams are radiated to a direction in which the angle θx is zero and the angle θy is −30. The horizontal axis in FIG. 4A and FIG. 4B represents the angle θy in units of "degrees" and the vertical axis in FIG. 4A and FIG. 4B represents the antenna gain in units of "dBi".

Referring to FIG. 4A and FIG. 4B, a bold sold line, a thin solid line, and a broken line indicate the antenna gains in a state in which the second radiation elements 22 are terminated with 50Ω, a state in which the second radiation elements 22 are short-circuited to the ground, and the floating state, respectively.

From the results of simulation illustrated in FIG. 4A and FIG. 4B, it was confirmed that the beam patterns radiated from the first radiation elements 21 are capable of being varied depending on the termination state of the second radiation elements 22. The beam patterns illustrated in FIG. 4A and FIG. 4B differ from the beam patterns in a first state in which power is supplied to the second radiation elements 22.

It was confirmed that switching the second radiation elements 22 from the first state (a power feeding state) to a second state (the terminal impedance state, the open state, or the short-circuit condition) varies the directional characteristics of the first radiation elements 21. Switching the second radiation elements 22 between the first state and the second state in the above manner enables the beam forming of the first radiation elements 21 to be fine-tuned. In addition, varying the termination state in the second state enables the beam forming of the first radiation elements 21 to be fine-tuned.

It was also confirmed that the angle θy indicating a null point is also varied with the termination state of the second radiation elements 22, although not illustrated in the graph in FIG. 4B. Fine-tuning the beam forming so that the direction from which a jamming signal comes coincides with the null point reduces the influence of the jamming signal.

Figure 5A:
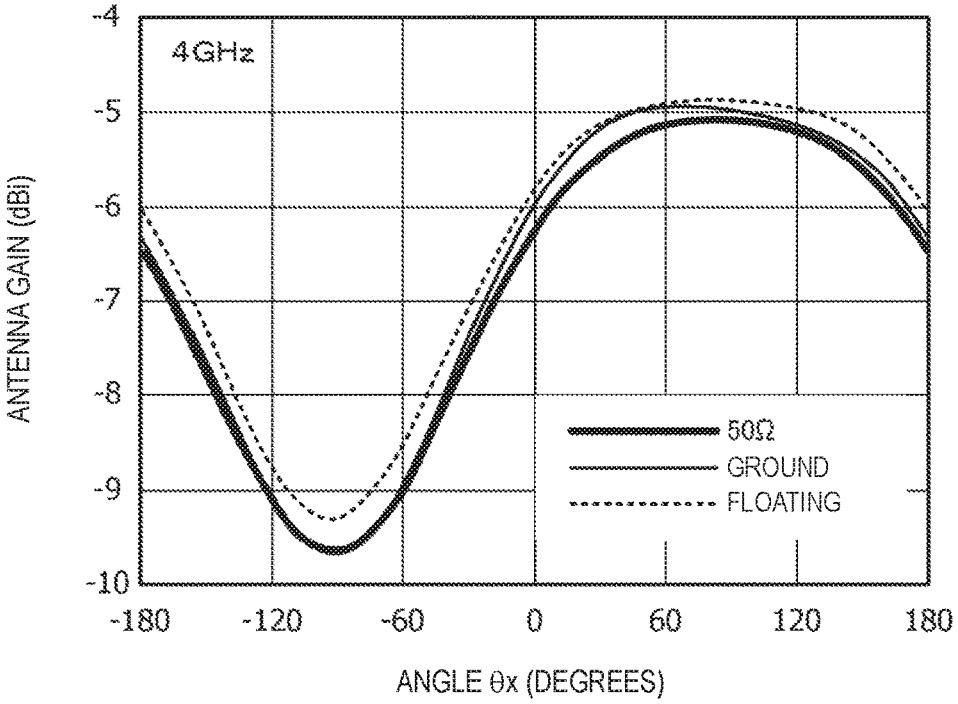
FIG. 5A and FIG. 5B are graphs illustrating results of simulation of the radiation characteristics when a 4-GHz signal was applied to a second radiation element in the y-axis positive direction.
Figure 5B:
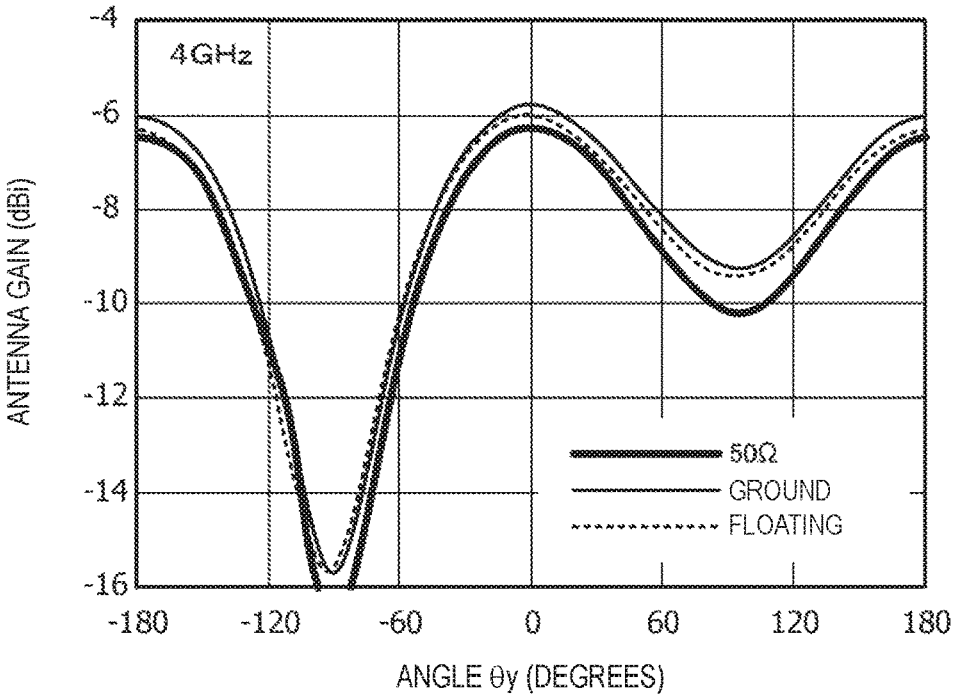

FIG. 5A and FIG. 5B are graphs illustrating results of simulation of the radiation characteristics when a 4-GHz signal was applied to the second radiation element 22 in the y-axis positive direction (FIG. 3). FIG. 5A illustrates the radiation characteristics in an xz plane and FIG. 5B illustrates the radiation characteristics in a yz plane. The horizontal axis in FIG. 5A represents the angle θx in units of "degrees" and the horizontal axis in FIG. 5B represents the angle θy in units of "degrees". The vertical axis in FIG. 5A and FIG. 5B represents the antenna gain in units of "dBi".

Referring to FIG. 5A and FIG. 5B, a bold sold line, a thin solid line, and a broken line indicate the antenna gains in a state in which the first radiation elements 21 were terminated with 50Ω, a state in which the first radiation elements 21 were short-circuited to the ground, and the floating state, respectively. The second radiation element 22 in the y-axis negative direction (FIG. 3) was terminated with 50Ω.

From the results of simulation illustrated in FIG. 5A and FIG. 5B, it was confirmed that the beam patterns radiated from the second radiation elements 22 are capable of being varied depending on the termination state of the first radiation elements 21. Varying the termination state of the first radiation elements 21 enables the beam forming of the second radiation elements 22 to be fine-tuned. A method of varying the termination state of the first radiation elements 21 will be specifically described below with reference to FIG. 16.

The beam patterns illustrated in FIG. 5A and FIG. 5B differ from the beam patterns of the second radiation elements 22 when the first radiation elements 21 are set to the power feeding state. Switching between the state in which power is applied to the first radiation elements 21 and the state in which the first radiation elements 21 are terminated with the terminal impedance enables the directional characteristics of the second radiation elements 22 to be varied.

Modification of First Embodiment

In the first embodiment, the first radiation elements 21 can be designed so as to operate in a frequency band of about 10 GHz or higher and the second radiation elements 22 can be designed so as to operate in a frequency band lower than that of the first radiation elements 21. For example, the first radiation elements 21 can be designed so as to operate in a high frequency band used in the fifth-generation mobile communication systems (a 28-GHz band or the millimeter-wave band).

In addition, the second radiation elements 22 can be designed so as to operate in a frequency band of about 6 GHz or lower. For example, the second radiation elements 22 can be designed so as to operate in a low frequency band (about 6 GHz or lower) used in the fifth-generation mobile communication systems. Alternatively, for example, the second radiation elements 22 can be designed so as to operate in any frequency band of not lower than about 600 MHz and not higher than about 960 MHz and any frequency band not lower than about 1.9 GHz and not higher than about 3.6 GHz, which are used in the third-generation or fourth-generation mobile communication systems. Alternatively, the second radiation elements 22 can be designed so as to operate in a 2.4-GHz band used in WiFi communication systems.

Although the four first radiation elements 21 are arranged in a two-dimensional pattern in the first embodiment, other arrangement may be adopted. For example, two or more first radiation elements 21 may be arranged in a one-dimensional pattern or three or more first radiation elements 21 may be arranged in a two-dimensional pattern.

A flexible substrate can be used as the dielectric substrate 20. The use of a flexible substrate produces an effect of improving the degree of freedom of the position where the multi-antenna module is installed. For example, a substrate having a property in which the substrate is capable of being deformed and the shape after the deformation is kept can be used as the dielectric substrate 20.

Second Embodiment

A multi-antenna module according to a second embodiment will now be described with reference to FIG. 6, FIG. 7A, FIG. 7B, and FIG. 7C. A description of components common to the components in the multi-antenna module (FIG. 1A, FIG. 1B, and FIG. 2) according to the first embodiment is omitted herein.

Figure 6:
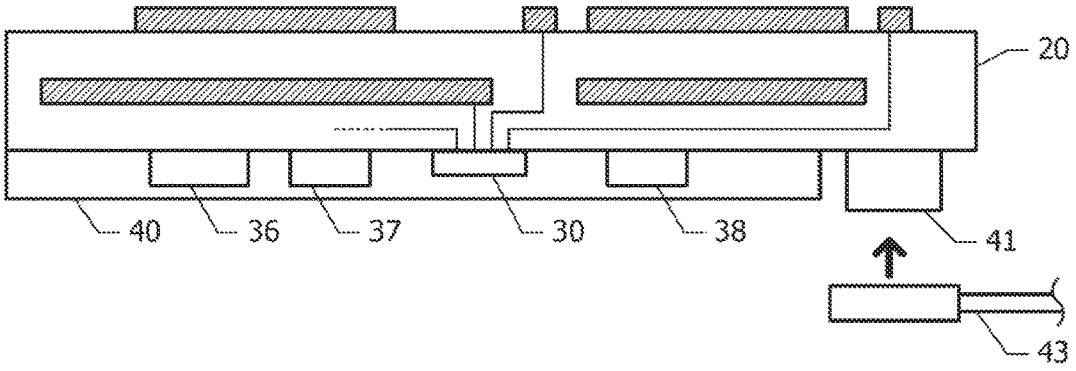
FIG. 6 is a cross-sectional view of a multi-antenna module according to a second embodiment.

FIG. 6 is a cross-sectional view of the multi-antenna module according to the second embodiment. The switch element 30 (FIG. 1B) is mounted on the rear face of the dielectric substrate 20 in the first embodiment. In contrast, in addition to the switch element 30, the transmission-reception circuit 36 and the first front end circuits 37 for the first radiation elements 21, the second front end circuits 38 for the second radiation elements 22, and a coaxial connector 41 are mounted on the rear face of the dielectric substrate 20 in the second embodiment. The transmission-reception circuit 36 is composed of, for example, a radio-frequency integrated circuit (RFIC). The first front end circuits 37 and the second front end circuits 38 are modularized. The conductor columns 31 (FIG. 1B) in the multi-antenna module according to the first embodiment are not arranged. The transmission-reception circuit 36, the first front end circuits 37, and the second front end circuits 38 are sealed with the sealing resin 40. A coaxial cable 43 is to be connected to the coaxial connector 41. The sealing resin 40 needs not to be provided.

Figure 7A:
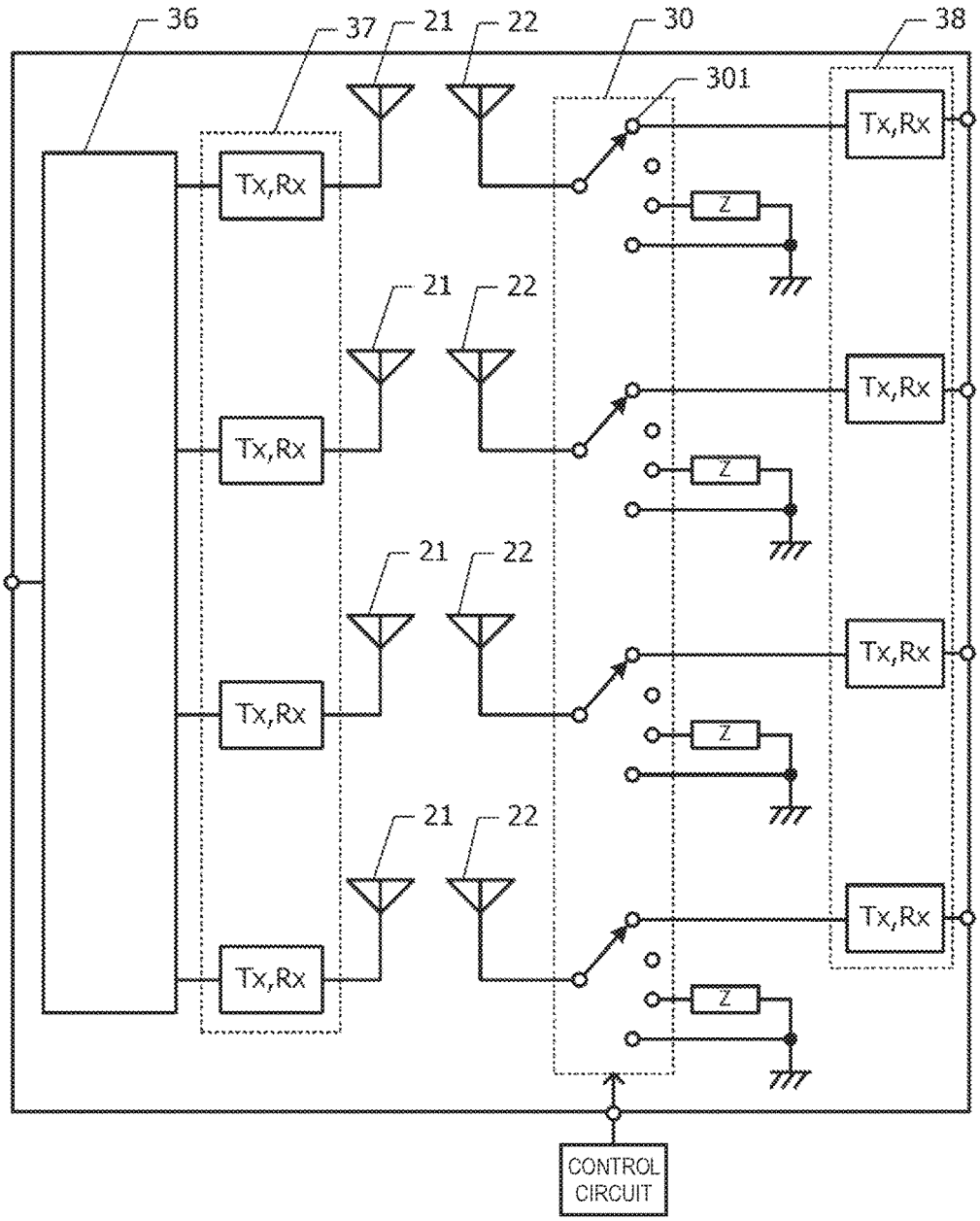
FIG. 7A is a block diagram of the multi-antenna module according to the second embodiment and FIG. 7B and FIG. 7C are block diagrams of front end circuits.
Figure 7B:
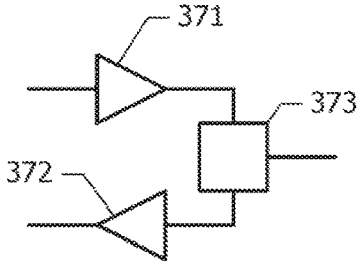

FIG. 7A is a block diagram of the multi-antenna module according to the second embodiment. The multiple first radiation elements 21 are connected to the corresponding first front end circuits 37. The first front end circuit 37 includes a power amplifier 371, a low noise amplifier 372, a duplexer 373, a filter circuit, a matching circuit, and so on for each first radiation element 21, as illustrated in FIG. 7B. The power amplifier 371 has a function to amplify a transmission signal. The low noise amplifier 372 has a function to amplify a reception signal. The duplexer 373 has a function to switch between transmission and reception. The multiple first front end circuits 37 are connected to the transmission-reception circuit 36. The transmission-reception circuit 36 includes a modulation-demodulation circuit that performs generation of the transmission signal and reception of the reception signal and an amplifier circuit.

Figure 7C:
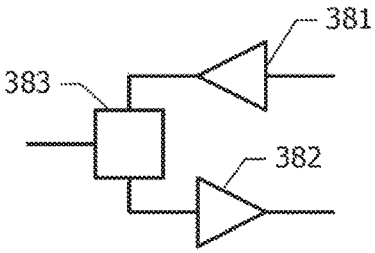

The first terminal 301 of each of the multiple pole four throw switches composing the switch element 30 is connected to the corresponding second front end circuit 38. The second front end circuit 38 includes a power amplifier 381, a low noise amplifier 382, a duplexer 383, a filter circuit, a matching circuit, and so on for each second radiation element 22, as illustrated in FIG. 7C.

Advantages of the multi-antenna module according to the second embodiment will now be described.

In the second embodiment, the transmission-reception circuit 36, the first front end circuits 37, and the second front end circuits 38 are mounted on the dielectric substrate 20 on which the first radiation elements 21 and the second radiation elements 22 are arranged. Accordingly, propagation loss of signals is capable of being reduced. In addition, a wireless device in which the multi-antenna module is installed is capable of being reduced in size, compared with a structure in which the transmission-reception circuit 36, the first front end circuits 37, and the second front end circuits 38 are externally provided.

In particular, the propagation loss of signals is increased in a frequency band of about 10 GHz or higher in which the first radiation elements 21 operate. Mounting the transmission-reception circuit 36 from which power is applied to the first radiation elements 21 on or in the dielectric substrate 20 on which the first radiation elements 21 are arranged achieves a pronounced effect of reducing the propagation loss.

A modification of the second embodiment will now be described. The coaxial connector 41 is provided to transmit and receive signals and power through the coaxial cable 43 in the second embodiment. Instead of the coaxial connector 41, the multiple conductor columns 31 may be arranged to compose a surface-mount multi-antenna module, like the multi-antenna module according to the first embodiment (FIG. 1B).

Third Embodiment

A multi-antenna module according to a third embodiment will now be described with reference to FIG. 8. A description of components common to the components in the multi-antenna module (FIG. 1A, FIG. 1B, and FIG. 2) according to the first embodiment is omitted herein.

Figure 8:
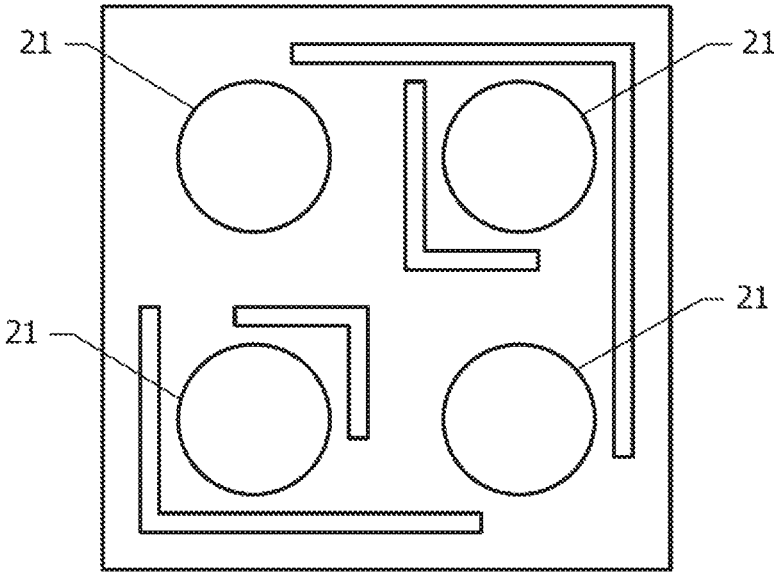
FIG. 8 is a plan view of a multi-antenna module according to a third embodiment.

FIG. 8 is a plan view of the multi-antenna module according to the third embodiment. Each first radiation element 21 has a substantially square or rectangular planar shape in the first embodiment while each first radiation element 21 has a substantially circular planar shape in the third embodiment. For example, the radio waves that are radiated become circular polarized waves by arranging the feeding point on each of two radii having a central angle of about 90 degrees for each of the circular first radiation elements 21.

Fourth Embodiment

A multi-antenna module according to a fourth embodiment will now be described with reference to FIG. 9A to FIG. 12B. A description of components common to the components in the multi-antenna module (FIG. 1A, FIG. 1B, and FIG. 2) according to the first embodiment is omitted herein.

Figure 9C:
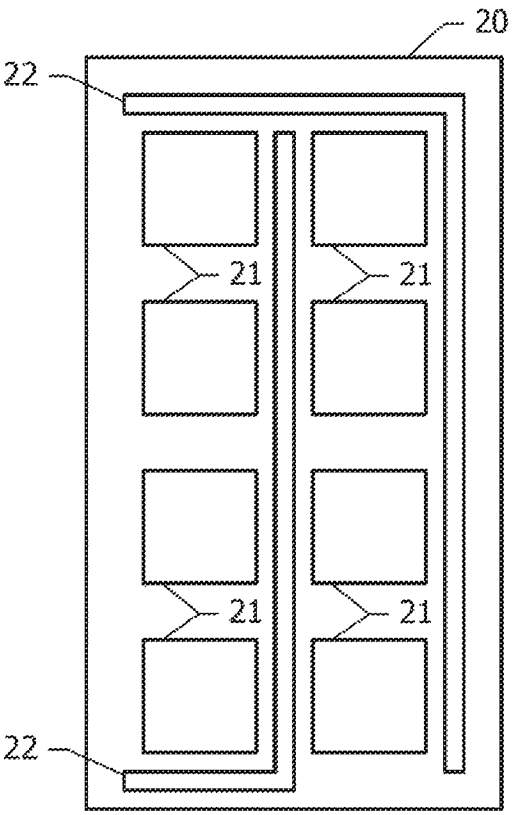
FIG. 9A, FIG. 9B, and FIG. 9C are plan views of a multi-antenna module according to a fourth embodiment.
Figure 9B:
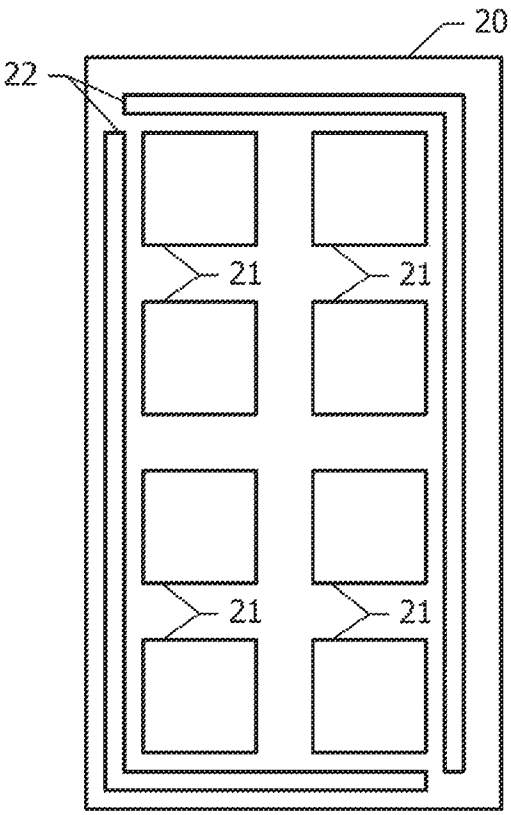
Figure 9A:
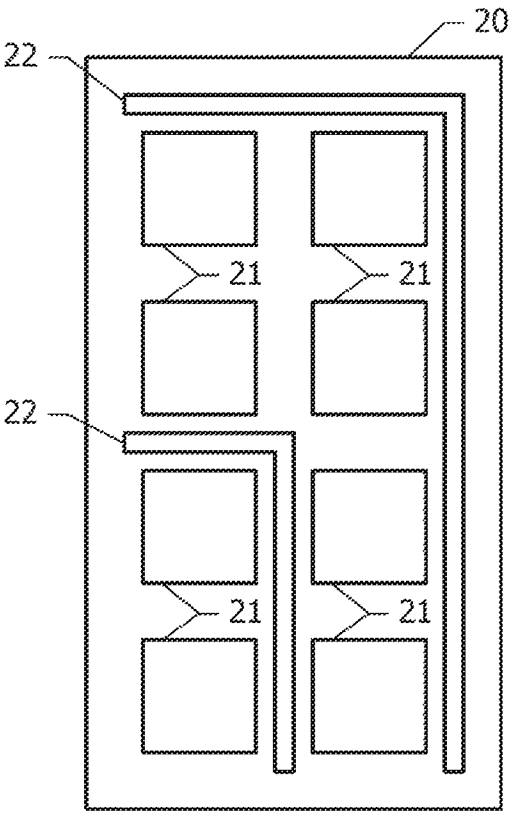

FIG. 9A is a plan view of the multi-antenna module according to the fourth embodiment. The four first radiation elements 21 are arranged in the 2×2 matrix in the first embodiment (FIG. 1A) while eight first radiation elements 21 are arranged in a 4×2 matrix in the fourth embodiment. The second radiation elements 22 are arranged between the first radiation elements 21 and outside an area where the eight first radiation elements 21 are arranged. In the example illustrated in FIG. 9A, one of the second radiation elements 22 has a substantially L shape having a length corresponding to about two first radiation elements 21 in the row direction and having a length corresponding to about four first radiation elements 21 in the column direction. The other of the second radiation elements 22 has a substantially L shape having a length corresponding to about one first radiation element 21 in the row direction and having a length corresponding to about two first radiation elements 21 in the column direction.

FIG. 9B is a plan view of the multi-antenna module according to the fourth embodiment, in which the pattern of the second radiation elements 22 is varied. In the example illustrated in FIG. 9B, no second radiation element 22 is arranged between the first radiation elements 21 and the second radiation elements 22 are arranged only outside the area where the eight first radiation elements 21 are arranged. Each of the two second radiation elements 22 has a substantially L shape having a length corresponding to about two first radiation elements 21 in the row direction and having a length corresponding to about four first radiation elements 21 in the column direction.

FIG. 9C is a plan view of the multi-antenna module according to the fourth embodiment, in which the pattern of the second radiation elements 22 is further varied. In the example illustrated in FIG. 9C, one of the second radiation elements 22 has a substantially L shape having a length corresponding to about two first radiation elements 21 in the row direction and having a length corresponding to about four first radiation elements 21 in the column direction, as in the example illustrated in FIG. 9A. The other of the second radiation elements 22 has a substantially L shape having a length corresponding to about one first radiation element 21 in the row direction and having a length corresponding to about four first radiation elements 21 in the column direction.

As illustrated in FIG. 9A to FIG. 9C, the resonant frequency of the second radiation elements 22 is capable of being varied by varying the lengths of the second radiation elements 22. The lengths of the second radiation elements 22 are set depending on the frequency band that is used.

Since the four first radiation elements 21 are arranged in the column direction in the fourth embodiment, the directivity of a narrower beam width in the column direction is achieved, compared with the first embodiment in which the two first radiation elements 21 are arranged in the column direction.

Results of simulation of the directional characteristics of the multi-antenna module according to the fourth embodiment will now be described with reference to FIG. 10 to FIG. 12B.

Figure 10:
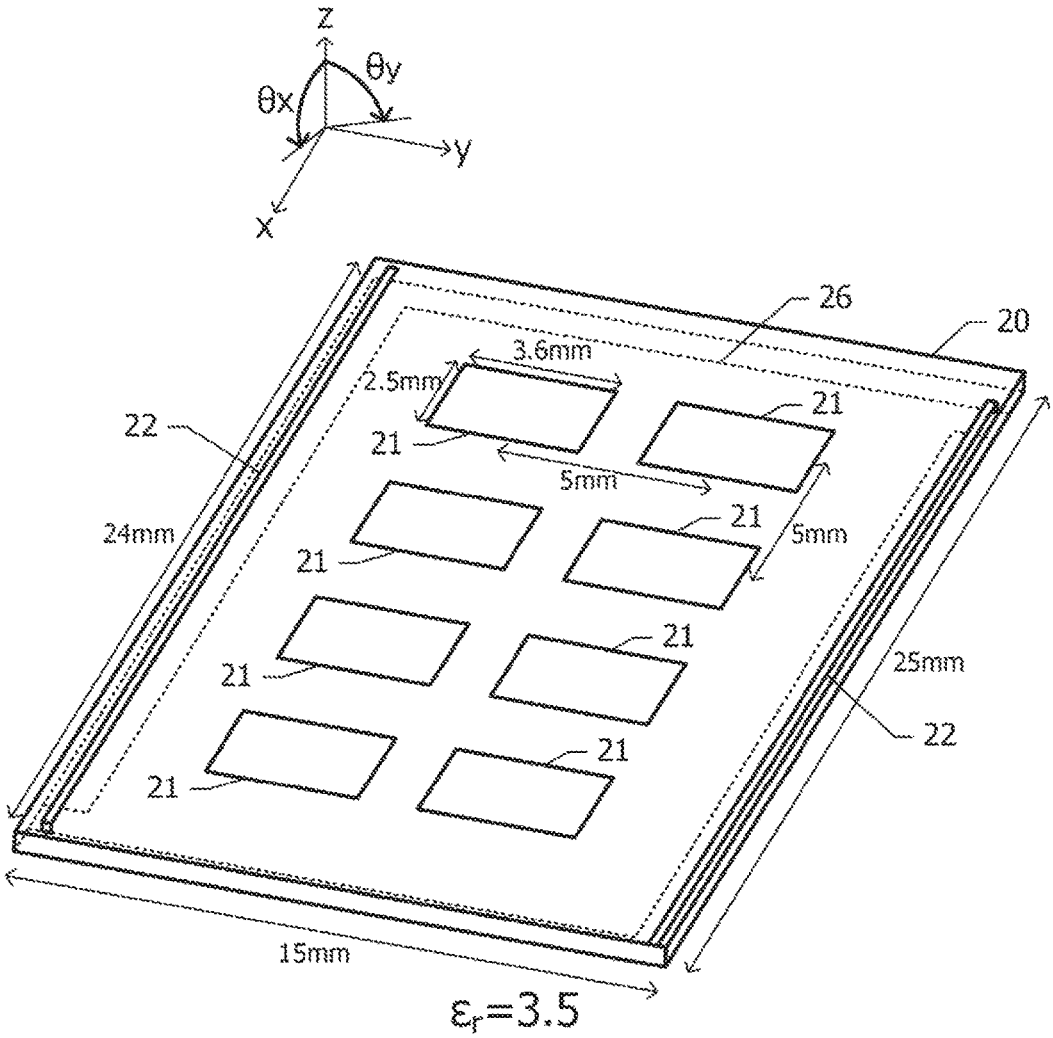
FIG. 10 is a schematic perspective view of a multi-antenna module that was simulated.

FIG. 10 is a schematic perspective view of a multi-antenna module that was simulated. A rectangular substrate the length of the long sides of which is 25 mm and the length of the short sides of which is 15 mm was used as the dielectric substrate 20. The relative permittivity εr of the dielectric substrate 20 was set to 3.5 as an example. An xyz Cartesian coordinate system was defined in which the direction of the long sides of the dielectric substrate 20 is the x axis, the direction of the short sides of the dielectric substrate 20 is the y axis, and the normal direction of the top face is the z axis. Eight first radiation elements 21 and two second radiation elements 22 were arranged on the top face of the dielectric substrate 20. The ground plane 26 was arranged on the rear face of the dielectric substrate 20.

The four first radiation elements 21 were arranged in the x-axis direction and the two first radiation elements 21 were arranged in the y-axis direction. Each of the first radiation elements 21 has a rectangular planar shape in which the dimension in the x-axis direction is 2.5 mm and the dimension in the y-axis direction is 3.6 mm. The distance between the centers in the x-axis direction of the first radiation elements 21 and the distance between the centers in the y-axis direction of the first radiation elements 21 were set to 5.0 mm. The feeding point of each of the first radiation elements 21 was arranged slightly on the inside of the midpoint of the side in the x-axis positive direction.

The respective second radiation elements 22 were arranged along and slightly inside the two respective long sides parallel to the x axis of the top face of the dielectric substrate 20. The length of each of the second radiation element 22 was set to 24 mm. The feeding point of the second radiation element 22 arranged in the y-axis positive direction was arranged at the end portion in the x-axis negative direction, and the feeding point of the second radiation element 22 arranged in the y-axis negative direction was arranged at the end portion in the x-axis positive direction.

Each first radiation element 21 and the ground plane 26 operate as a 28-GHz patch antenna. Each of the second radiation elements 22 operates as a 2-GHz monopole antenna.

An angle from the normal direction of the top face of the dielectric substrate 20 to the y-axis positive direction was denoted by θy, and an angle from the normal direction of the top face of the dielectric substrate 20 to the x-axis positive direction was denoted by θx.

Figure 11A:
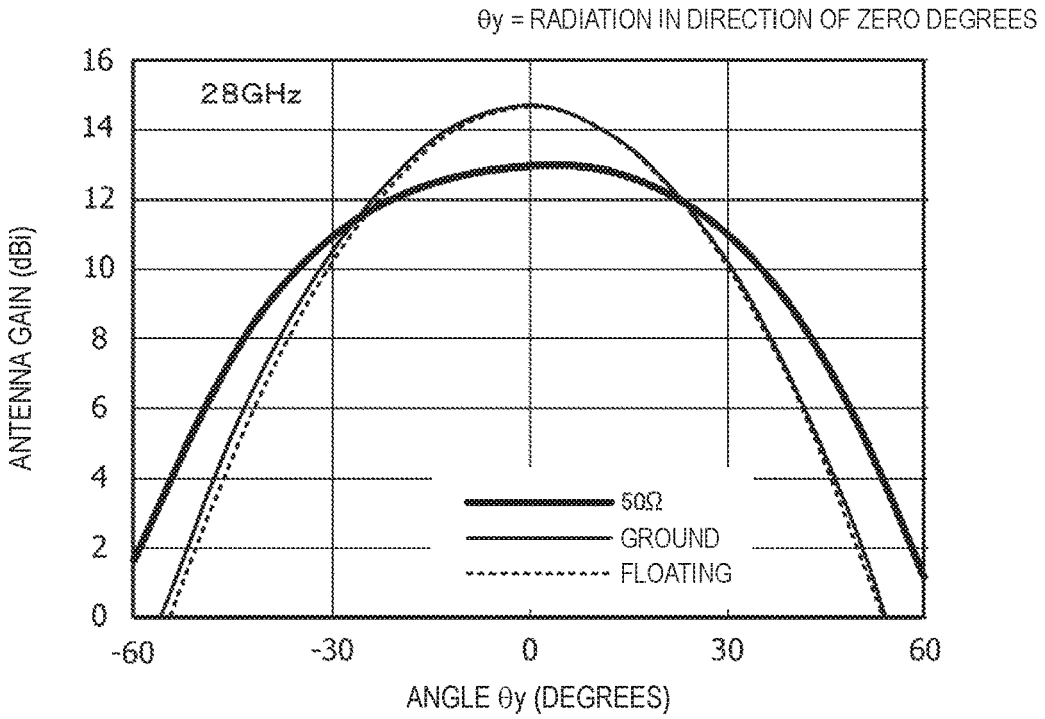
FIG. 11A is a graph illustrating a result of simulation of the radiation characteristics when 28-GHz signals of the same phase were applied to eight first radiation elements and FIG. 11B is a graph illustrating a result of simulation of the radiation characteristics when 28-GHz signals were applied to the eight first radiation elements, the phase of the signals applied to the four first radiation elements in the y-axis positive direction advancing from the phase of the signals applied to the four first radiation elements in the y-axis negative direction by 90 degrees.
Figure 11B:
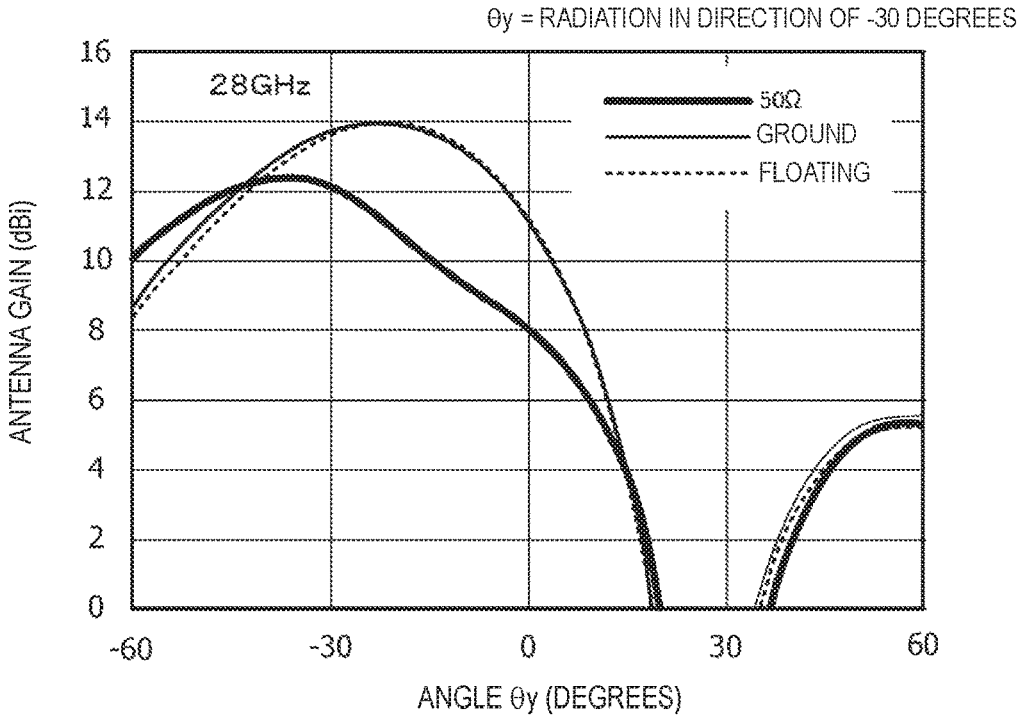

FIG. 11A is a graph illustrating a result of simulation of the radiation characteristics when 28-GHz signals of the same phase were applied to the eight first radiation elements 21 (FIG. 10). The graph in FIG. 11A corresponds to an example in which the beams are radiated to a direction in which the angle θx and the angle θy are zero. FIG. 11B is a graph illustrating a result of simulation of the radiation characteristics when 28-GHz signals were applied to the eight first radiation elements 21 (FIG. 10). The phase of the signals applied to the four first radiation elements 21 in the y-axis positive direction advances from the phase of the signals applied to the four first radiation elements 21 in the y-axis negative direction by 90 degrees. The graph in FIG. 11B corresponds to an example in which the beams are radiated to a direction in which the angle θx is zero and the angle θy is −30. The horizontal axis in FIG. 11A and FIG. 11B represents the angle θy in units of "degrees" and the vertical axis in FIG. 11A and FIG. 11B represents the antenna gain in units of "dBi".

Referring to FIG. 11A and FIG. 11B, a bold sold line, a thin solid line, and a broken line indicate the antenna gains in a state in which the second radiation elements 22 are terminated with 50Ω, a state in which the second radiation elements 22 are short-circuited to the ground, and the floating state, respectively.

From the results of simulation illustrated in FIG. 11A and FIG. 11B, it was confirmed that the beam patterns radiated from the first radiation elements 21 are capable of being varied depending on the termination state of the second radiation elements 22. The beam patterns illustrated in FIG. 11A and FIG. 11B differ from the beam patterns in the first state in which power is supplied to the second radiation elements 22.

It was confirmed that switching the second radiation elements 22 from the first state (the power feeding state) to the second state (the terminal impedance state, the open state, or the short-circuit condition) varies the directional characteristics of the first radiation elements 21. Switching the second radiation elements 22 between the first state and the second state in the above manner enables the beam forming of the first radiation elements 21 to be fine-tuned. In addition, varying the termination state in the second state enables the beam forming of the first radiation elements 21 to be fine-tuned.

It was also confirmed that the angle θy indicating the null point is also varied with the termination state of the second radiation elements 22, although not illustrated in the graph in FIG. 11B. Fine-tuning the beam forming so that the direction from which the jamming signal comes coincides with the null point reduces the influence of the jamming signal.

Figure 12A:
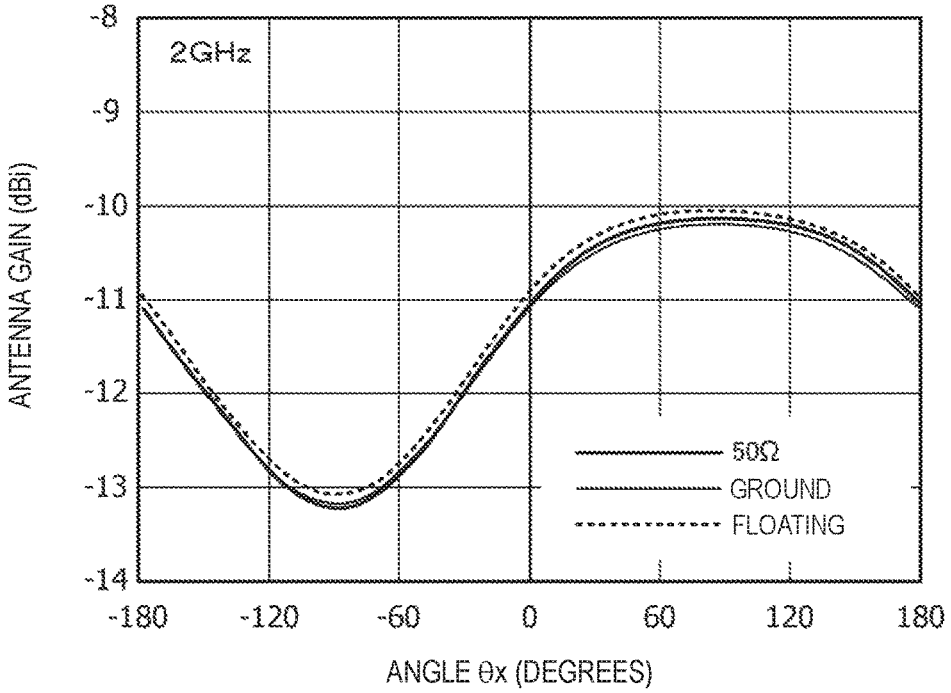
FIG. 12A and FIG. 12B are graphs illustrating results of simulation of the radiation characteristics when a 2-GHz signal was applied to a second radiation element in the y-axis positive direction.
Figure 12B:
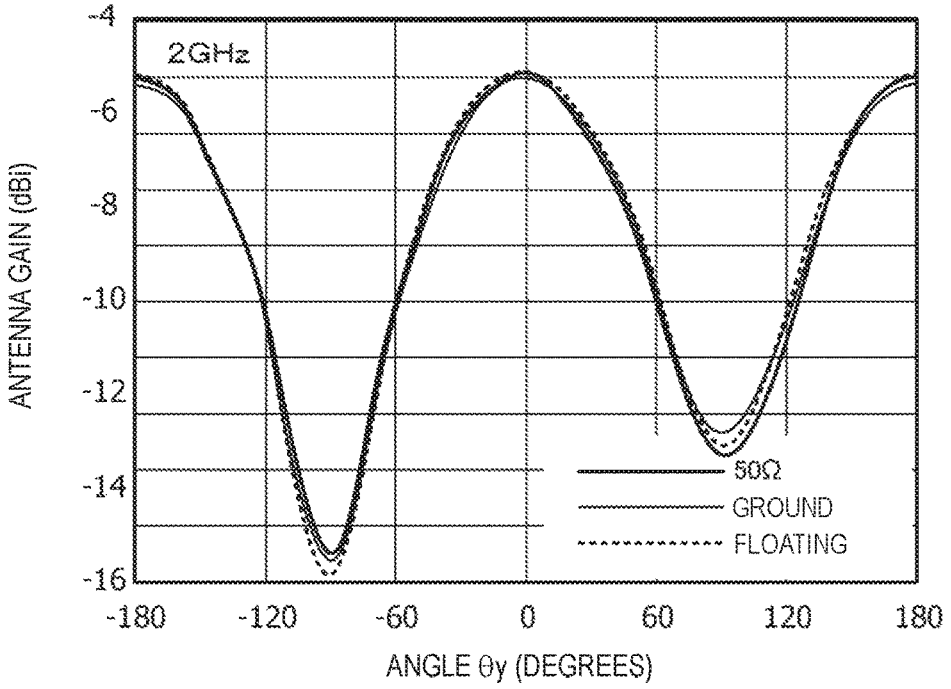

FIG. 12A and FIG. 12B are graphs illustrating results of simulation of the radiation characteristics when a 2-GHz signal was applied to the second radiation element 22 in the y-axis positive direction (FIG. 10). FIG. 12A illustrates the radiation characteristics in the xz plane and FIG. 12B illustrates the radiation characteristics in the yz plane. The horizontal axis in FIG. 12A represents the angle θx in units of "degrees" and the horizontal axis in FIG. 12B represents the angle θy in units of "degrees". The vertical axis in FIG. 12A and FIG. 12B represents the antenna gain in units of "dBi".

Referring to FIG. 12A and FIG. 12B, a bold sold line, a thin solid line, and a broken line indicate the antenna gains in the state in which the first radiation elements 21 were terminated with 50Ω, the state in which the first radiation elements 21 were short-circuited to the ground, and the floating state, respectively. The second radiation element 22 in the y-axis negative direction (FIG. 10) was terminated with 50Ω.

From the results of simulation illustrated in FIG. 12A and FIG. 12B, it was confirmed that the beam patterns radiated from the second radiation elements 22 are capable of being varied depending on the termination state of the first radiation elements 21. Varying the termination state of the first radiation elements 21 enables the beam forming of the second radiation elements 22 to be fine-tuned. A method of varying the termination state of the first radiation elements 21 will be specifically described below with reference to FIG. 16.

The beam patterns illustrated in FIG. 12A and FIG. 12B differ from the beam patterns of the second radiation elements 22 when the first radiation elements 21 are set to the power feeding state. Switching between the state in which power is applied to the first radiation elements 21 and the state in which the first radiation elements 21 are terminated with the terminal impedance enables the beam forming of the second radiation elements 22 to be fine-tuned.

Modifications of Fourth Embodiment

Multi-antenna modules according to modifications of the fourth embodiment will now be described with reference to FIG. 13A to FIG. 15.

Figure 13B:
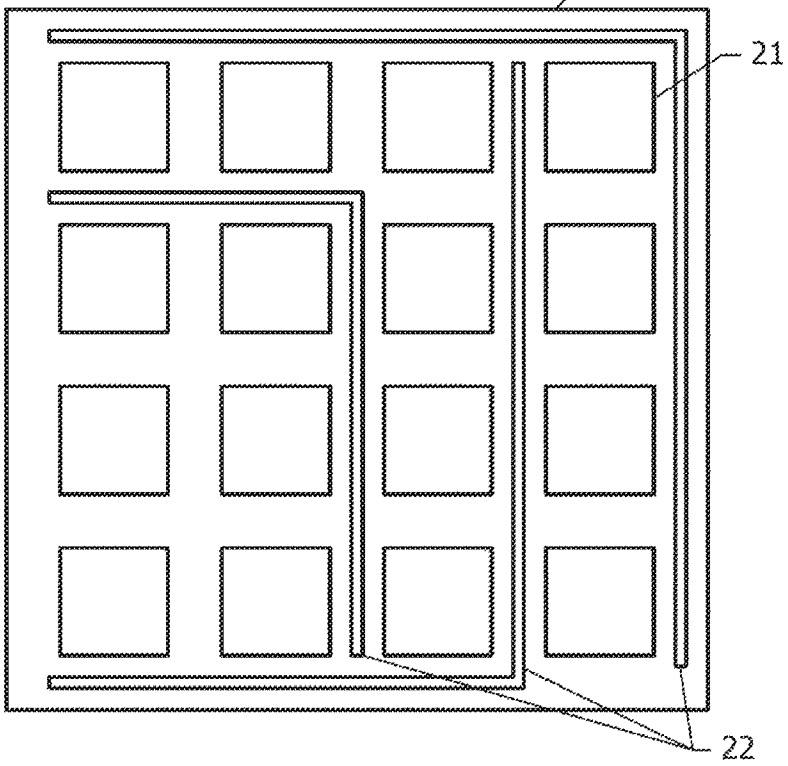
FIG. 13A and FIG. 13B are plan views of a multi-antenna module according to a modification of the fourth embodiment.
Figure 13A:
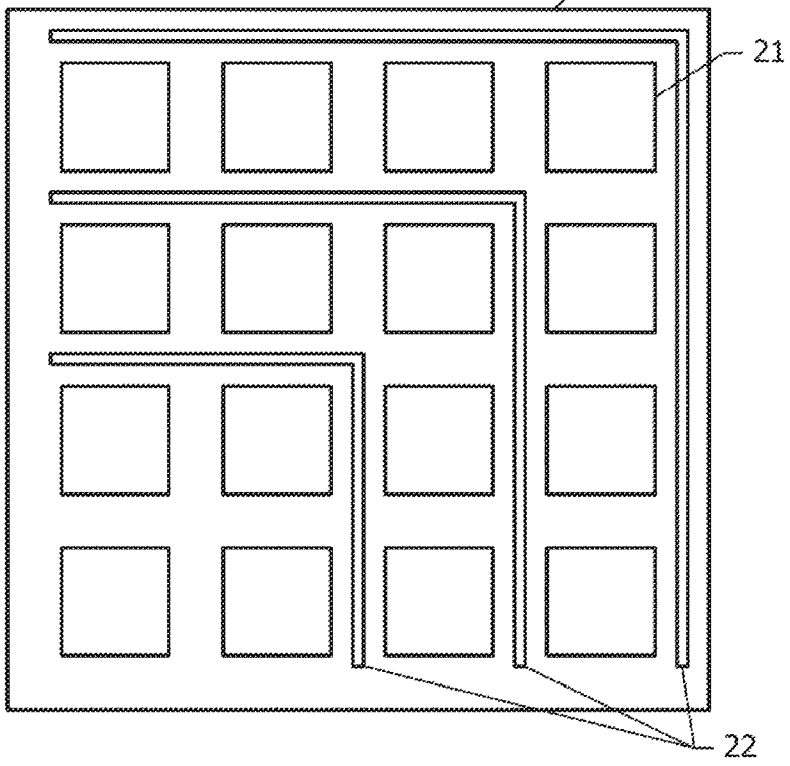

FIG. 13A and FIG. 13B are plan views of a multi-antenna module according to a modification of the fourth embodiment. The eight first radiation elements 21 are arranged in a matrix in the fourth embodiment (FIG. 9A to FIG. 9C) while 16 first radiation elements 21 are arranged in a 4×4 matrix in the modification illustrated in FIG. 13A and FIG. 13B. The multiple second radiation elements 22 are arranged between the first radiation elements 21 and outside an area where the multiple first radiation elements 21 are arranged.

As illustrated in FIG. 13A and FIG. 13B, increasing the number of the first radiation elements 21 enables the antenna gain to be improved. In addition, making the number of the first radiation elements 21 arranged in the row direction equal to the number of the first radiation elements 21 arranged in the column direction enables similar directivities of narrow beam widths to be realized in both the row direction and the column direction.

Figure 14B:
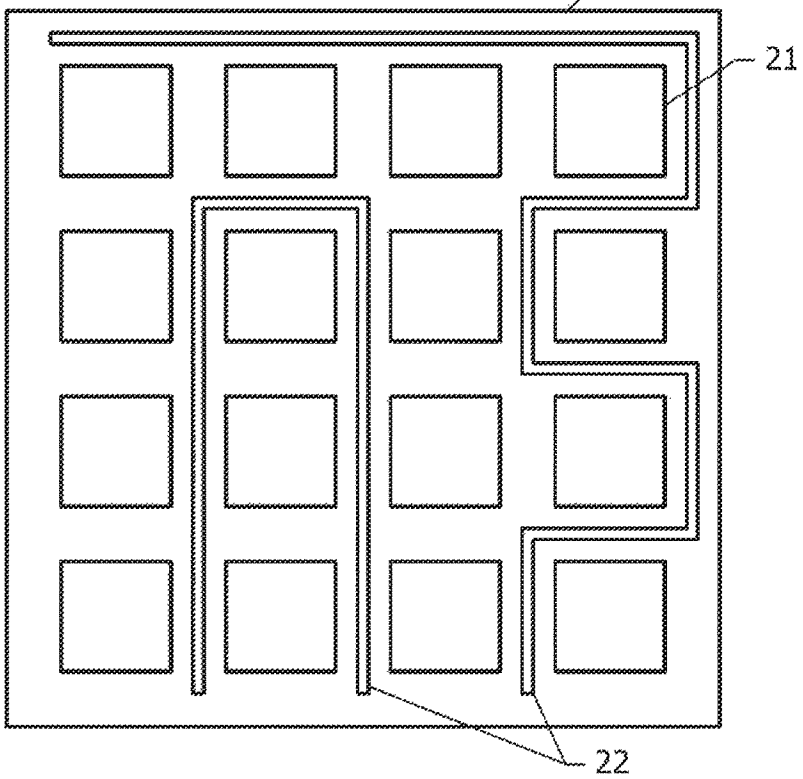
FIG. 14A and FIG. 14B are plan views of a multi-antenna module according to another modification of the fourth embodiment.
Figure 14A:
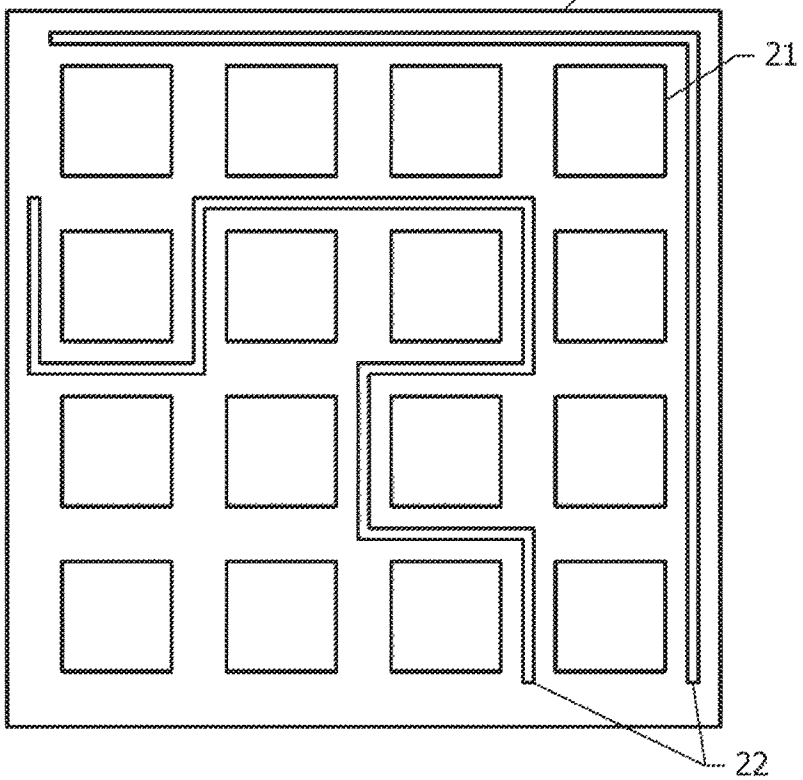

FIG. 14A and FIG. 14B are plan views of a multi-antenna module according to another modification of the fourth embodiment. In the modification illustrated in FIG. 14A and FIG. 14B, the second radiation elements 22 include portions of meander shapes. For example, portions that turn right and portions that turn left appear from one end to another end along the second radiation element 22.

As illustrated in FIG. 14A and FIG. 14B, forming the second radiation elements 22 into meander planar shapes enables the second radiation elements 22 to be increased in length within a predetermined area. Increasing the lengths of the second radiation elements 22 enables the second radiation elements 22 to operate at lower frequencies.

For example, in the simulation illustrated in FIG. 10, the second radiation elements 22 were arranged in linear patterns along the long sides of the dielectric substrate 20 to set the operating frequencies of the second radiation elements 22 to 2 GHz. Forming the second radiation elements 22 into substantially L-shaped patterns that extend in the row direction and the column direction, as illustrated in FIG. 13A and FIG. 13B, enables the second radiation elements 22 to operate at a frequency of about 1 GHz. In addition, forming the second radiation elements 22 into meander shapes, as illustrated in FIG. 14A and FIG. 14B, enables the second radiation elements 22 to operate at frequencies lower than about 1 GHz, for example, in a 800-MHz band or a 900-MHz band.

Figure 15:
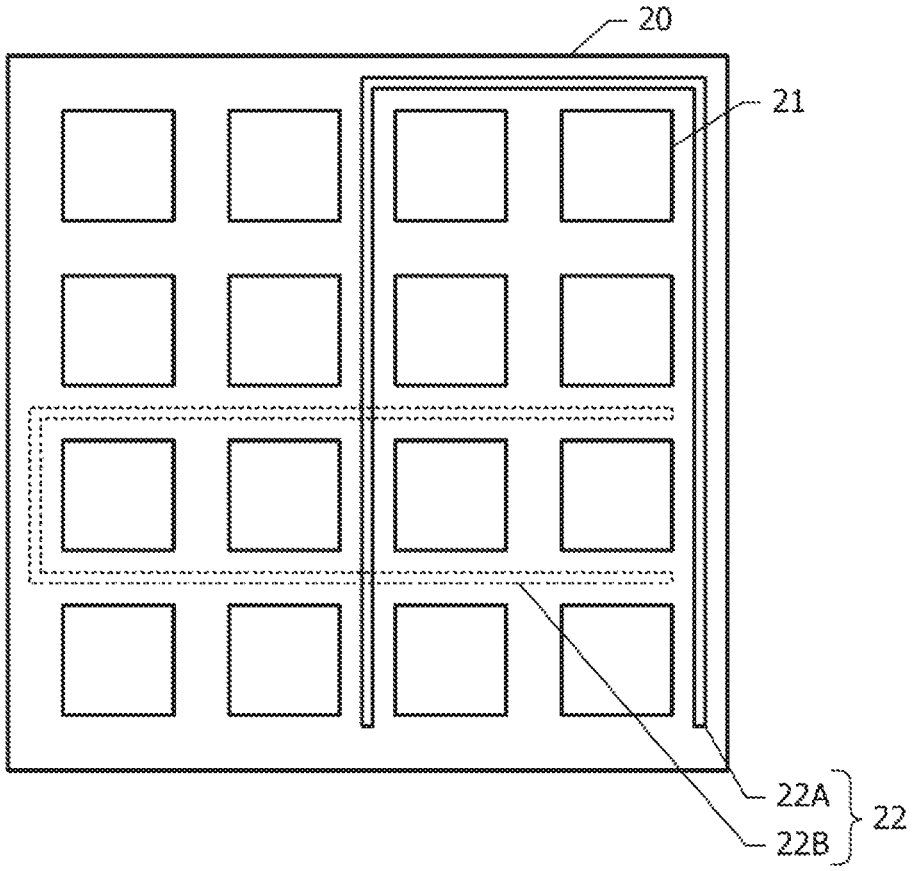
FIG. 15 is a plan view of a multi-antenna module according to another modification of the fourth embodiment.

FIG. 15 is a plan view of a multi-antenna module according to another modification of the fourth embodiment. The first radiation elements 21 and the second radiation elements 22 are arranged on the top face of the dielectric substrate 20 in the first embodiment (FIG. 1A and FIG. 1B) and the fourth embodiment. In contrast, in the modification illustrated in FIG. 15, the second radiation elements 22 are arranged not only on the top face of the dielectric substrate 20 but also on an inner layer of the dielectric substrate 20. Specifically, the second radiation elements 22 are arranged on multiple conductor layers of the dielectric substrate 20. In the modification illustrated in FIG. 15, one second radiation element 22A is arranged on the top face of the dielectric substrate 20 and the other second radiation element 22B is arranged on an inner layer of the dielectric substrate 20.

The second radiation element 22B arranged on a conductor layer (inner layer) different from that of the first radiation elements 21 is also arranged between the first radiation elements 21 and outside the first radiation elements 21 so as not to be overlapped with the first radiation elements 21, as in the second radiation element 22A arranged on the top face of the dielectric substrate 20. The second radiation element 22A on the top face and the second radiation element 22B on an inner layer intersect with each other in a plan view. The second radiation element 22A is orthogonal to the second radiation element 22B in a portion where the second radiation element 22A intersects with the second radiation element 22B.

Since the multiple second radiation elements 22 are capable of intersecting with each other in a plan view in the modification illustrated in FIG. 15, the degree of freedom of the arrangement of the second radiation elements 22 is increased. In addition, since the second radiation elements 22 are orthogonal to each other in the intersecting portion, electromagnetic coupling between the second radiation elements 22 is capable of being reduced.

Fifth Embodiment

A multi-antenna module according to a fifth embodiment will now be described with reference to FIG. 16. A description of components common to the components in the multi-antenna module (FIG. 1A, FIG. 1B, and FIG. 2) according to the first embodiment is omitted herein.

Figure 16:
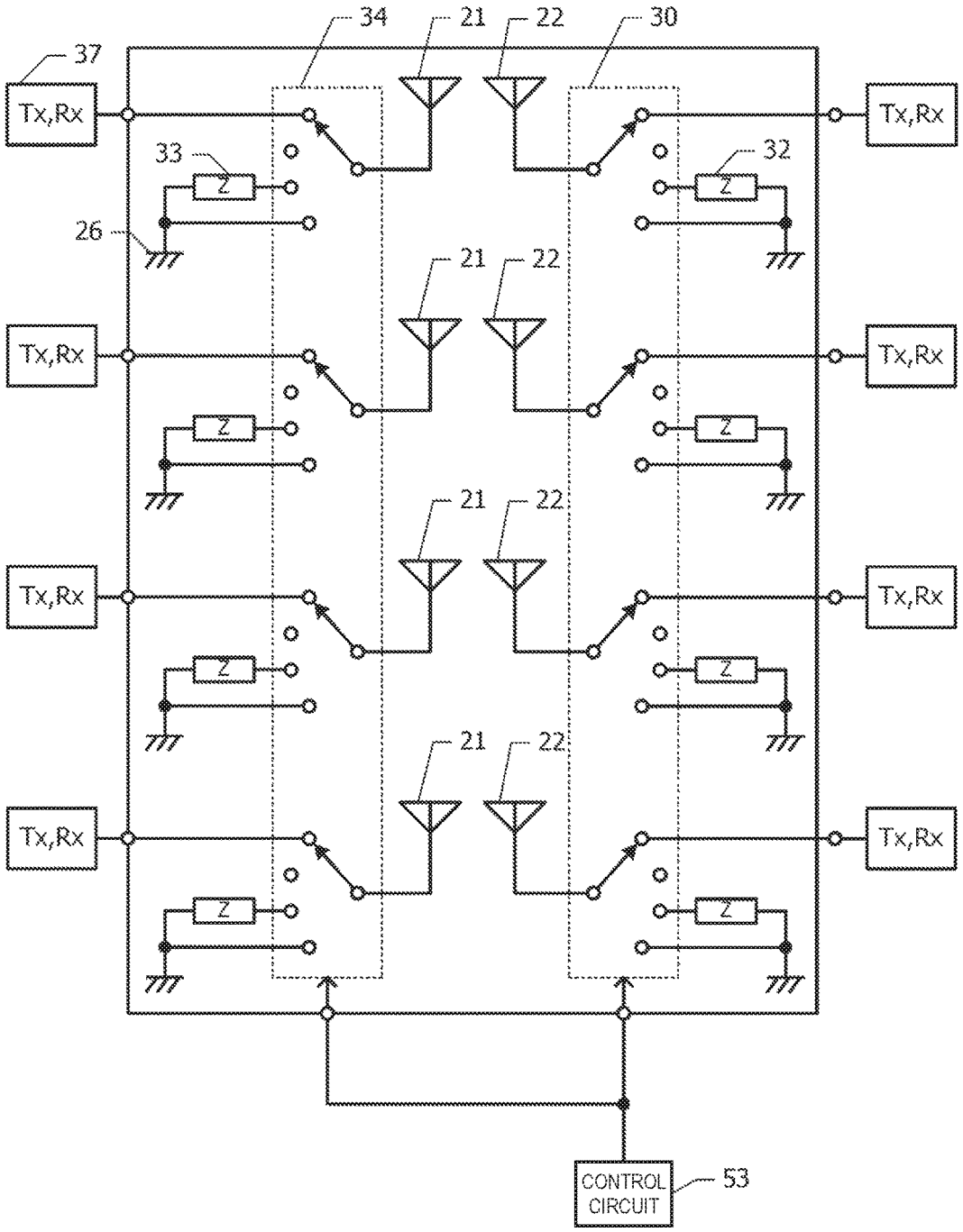
FIG. 16 is a block diagram of a multi-antenna module according to a fifth embodiment.

FIG. 16 is a block diagram of the multi-antenna module according to the fifth embodiment. The switch element 30 is connected to the second radiation elements 22 and the first radiation elements 21 are connected to the first front end circuits 37 with no switch element interposed therebetween in the first embodiment (FIG. 2). A switch element 34 is connected to the first radiation elements 21 in the fifth embodiment (FIG. 16).

The switch element 34 is used to switch between a third state in which each first radiation element 21 is connected to the corresponding first front end circuit 37 for power feeding and a fourth state in which the first radiation element 21 is not connected to the first front end circuit 37. The fourth state includes at least one of the state in which the first radiation element 21 is terminated with a terminal impedance 33, the open state of the first radiation element 21, and the short-circuit condition. The switching of the state of the switch element 34 is performed by the control circuit 53. The resistance component, the inductance component, and the capacitance component of the terminal impedance 33 can be set to fixed values, as in the terminal impedance 32. The terminal impedance 33 may be matched with the input impedance of the first radiation element 21 to make the first radiation element 21 the resistive terminator.

In the fifth embodiment, switching the state of the first radiation element 21 between the third state and the fourth state enables antenna characteristics of the second radiation element 22 to be fine-tuned. The fact that the antenna characteristics of the second radiation element 22 are capable of being fine-tuned is confirmed from the results of simulation illustrated in FIG. 5A, FIG. 5B, FIG. 12A, and FIG. 12B.

Sixth Embodiment

A multi-antenna module according to a sixth embodiment will now be described with reference to FIG. 17. A description of components common to the components in the multi-antenna module (FIG. 6, FIG. 7A, FIG. 7B, and FIG. 7C) according to the second embodiment is omitted herein.

Figure 17:
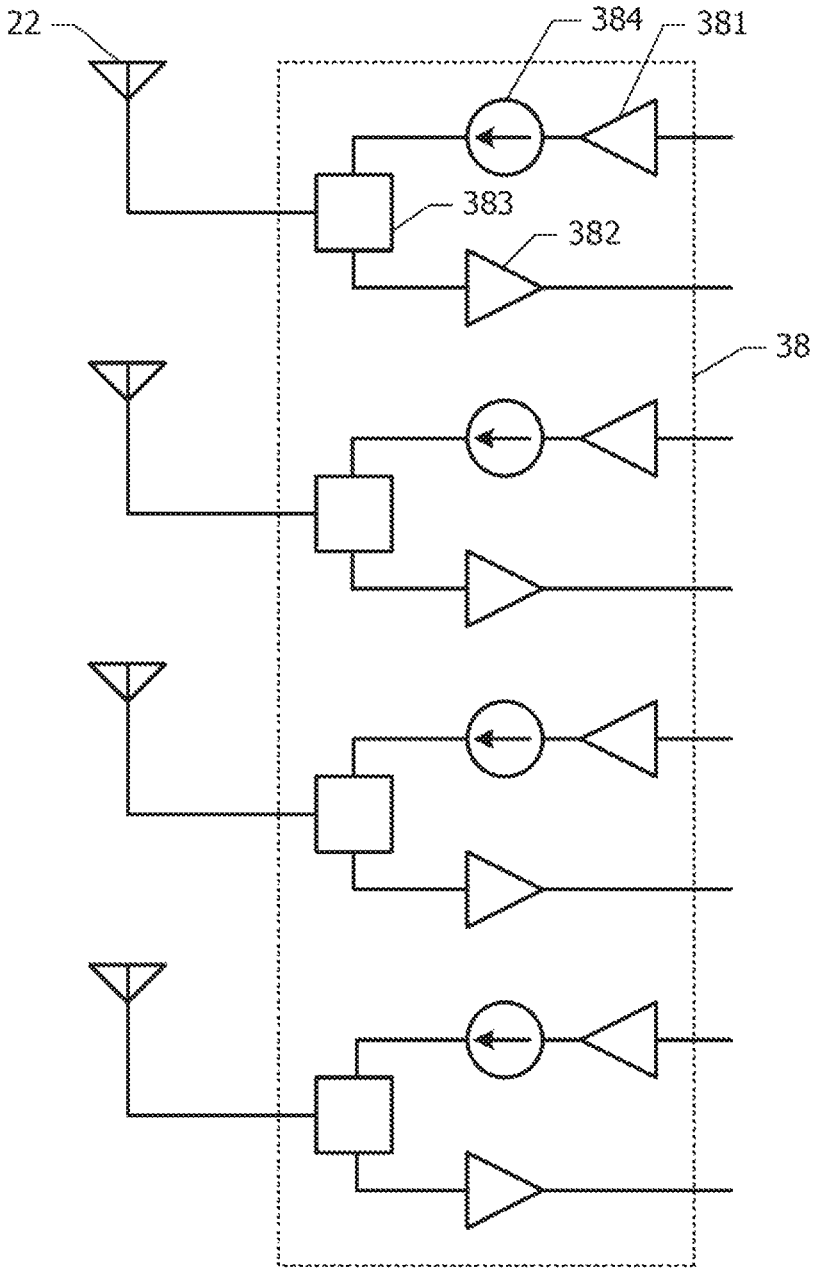
FIG. 17 is a block diagram of second radiation elements and second front end circuits in a multi-antenna module according to a sixth embodiment.

FIG. 17 is a block diagram of the second radiation elements 22 and the second front end circuits 38 in the multi-antenna module according to the sixth embodiment. The second front end circuit 38 (FIG. 7C) in the multi-antenna module according to the second embodiment includes the power amplifier 381, the low noise amplifier 382, and the duplexer 383. In contrast, the second front end circuit 38 in the multi-antenna module according to the sixth embodiment further includes an isolator 384 provided at the output side of the power amplifier 381.

Advantages of the multi-antenna module according to the sixth embodiment will now be described.

The radio waves in a high frequency band radiated from the first radiation element 21 may flow into an output end of the power amplifier 381 through the second radiation element 22. Distortion in the power amplifier 381 is increased due to the flowing of the signal in a high frequency band into the output end of the power amplifier 381. In the sixth embodiment, the flowing of the signal in a high frequency band into the output end of the power amplifier 381 is capable of being suppressed by providing the isolator 384. This suppresses an increase in the distortion in the power amplifier 381. In addition, the provision of the isolator 384 also produces an effect of suppressing the flowing of the radio waves radiated from another second radiation element 22 into the output end of the power amplifier 381 through the other second radiation element 22.

Seventh Embodiment

A multi-antenna module according to a seventh embodiment will now be described with reference to FIG. 18. A description of components common to the components in the multi-antenna module (FIG. 1A, FIG. 1B, and FIG. 2) according to the first embodiment is omitted herein.

Figure 18:
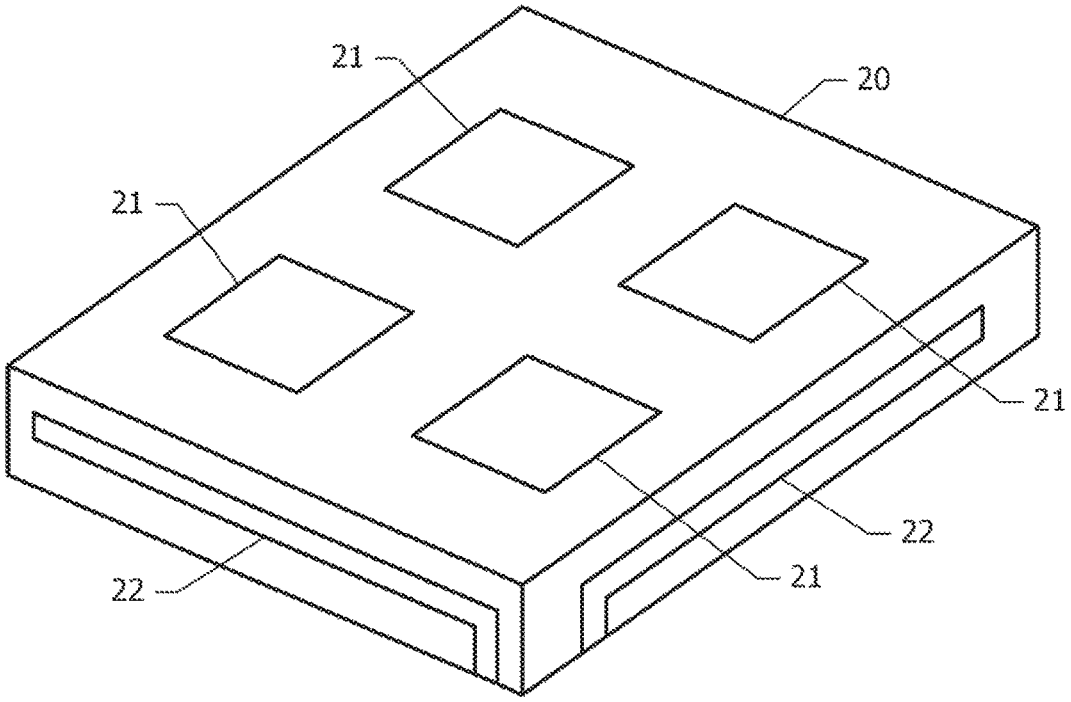
FIG. 18 is a perspective view of a multi-antenna module according to a seventh embodiment.

FIG. 18 is a perspective view of the multi-antenna module according to the seventh embodiment. The first radiation elements 21 and the second radiation elements 22 are arranged on the top face of the dielectric substrate 20 (FIG. 1A) in the first embodiment. In contrast, the first radiation elements 21 are arranged on the top face of the dielectric substrate 20 and the second radiation elements 22 are arranged on side faces with which the top face of the dielectric substrate 20 is connected to the bottom face of the dielectric substrate 20 in the seventh embodiment.

In the seventh embodiment, it is possible to cause the second radiation elements 22 arranged on the side faces of the dielectric substrate 20 to operate as the ground of the first radiation elements 21 or the parasitic elements. As a result, the beam forming of the first radiation elements 21 is capable of being fine-tuned.

Modification of Seventh Embodiment

A multi-antenna module according to a modification of the seventh embodiment will now be described with reference to FIG. 19.

Figure 19:
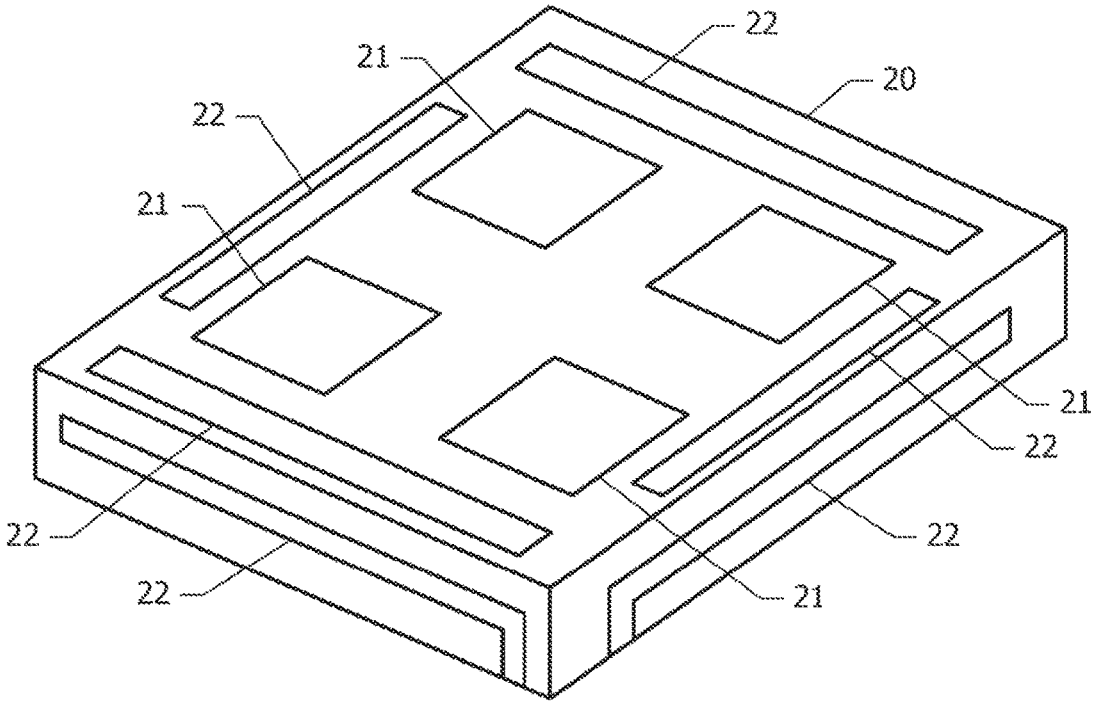
FIG. 19 is a perspective view of a multi-antenna module according to a modification of the seventh embodiment.

FIG. 19 is a perspective view of the multi-antenna module according to the modification of the seventh embodiment. The second radiation elements 22 (FIG. 18) are arranged on the side faces of the dielectric substrate 20 in the seventh embodiment while the second radiation elements 22 are arranged on both the top face of the dielectric substrate 20 and side faces thereof in the present modification.

The coupling between the first radiation elements 21 and the second radiation elements 22 arranged on the top face of the dielectric substrate 20 is stronger than the coupling between the first radiation elements 21 and the second radiation elements 22 arranged on the side faces of the dielectric substrate 20. Accordingly, the second radiation elements 22 arranged on the top face of the dielectric substrate 20 can be used for control of the beam forming of the first radiation elements 21.

Eighth Embodiment

A mobile terminal according to an eighth embodiment will now be described with reference to FIG. 20A, FIG. 20B, and FIG. 21. The multiple multi-antenna modules according to any of the first to seventh embodiments are installed in the mobile terminal according to the eight embodiment.

Figure 20A:
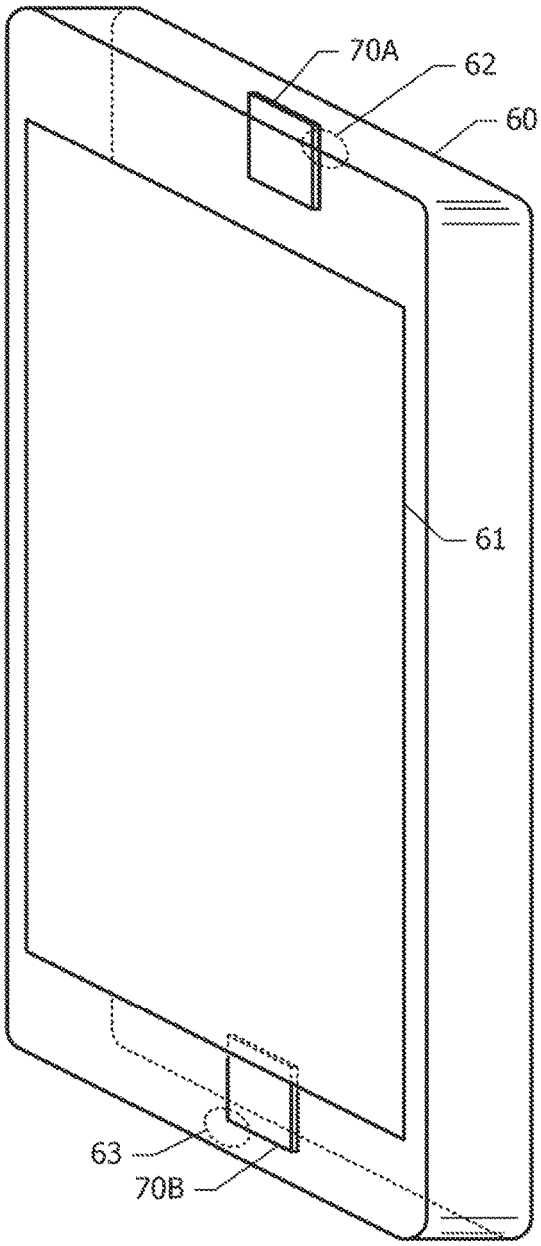
FIG. 20A is a schematic perspective view illustrating the inside of a mobile terminal according to an eighth embodiment and FIG. 20B is a plan view illustrating the inside thereof.
Figure 20B:
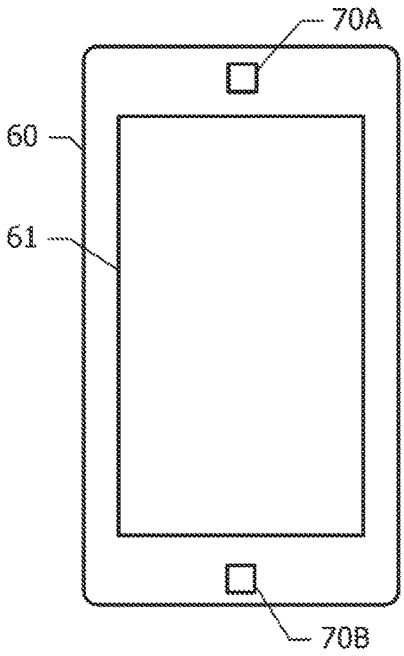

FIG. 20A is a schematic perspective view illustrating the inside of the mobile terminal according to the eighth embodiment and FIG. 20B is a plan view illustrating the inside thereof. An image display panel 61, a camera 62, a microphone 63, and multi-antenna modules 70A and 70B are housed in a housing 60. The two multi-antenna modules 70A and 70B have the same configuration as the multi-antenna module according to any of the first to seventh embodiments and have substantially the same configuration as the multi-antenna module according to any of the first to seventh embodiments. For example, a liquid crystal display panel or an organic electroluminescent (EL) panel may be used as the image display panel 61.

The image display panel 61 has a shape in which the dimension in a first direction (hereinafter referred to as a length direction), among the two directions orthogonal to each other in a plan view, is greater than the dimension in a second direction (hereinafter referred to as a width direction). The housing 60 also has an outer shape in which the dimension in the length direction is greater than the dimension in the width direction in a plan view. The dimension (thickness) of the housing 60 in a direction (hereinafter referred to as a thickness direction) that is orthogonal to the length direction and the width direction is smaller than the dimension in the length direction and the dimension in the width direction.

The camera 62 and the microphone 63 are respectively arranged near both ends in the length direction of the housing 60. The two multi-antenna modules 70A and 70B are arranged at a side opposite to that of the display surface of the image display panel 61 in the thickness direction and are arranged outside both ends in the length direction of the image display panel 61 in an in-plane direction. For example, the multi-antenna module 70A is arranged near the camera 62 and the multi-antenna module 70B is arranged near the microphone 63.

Figure 21:
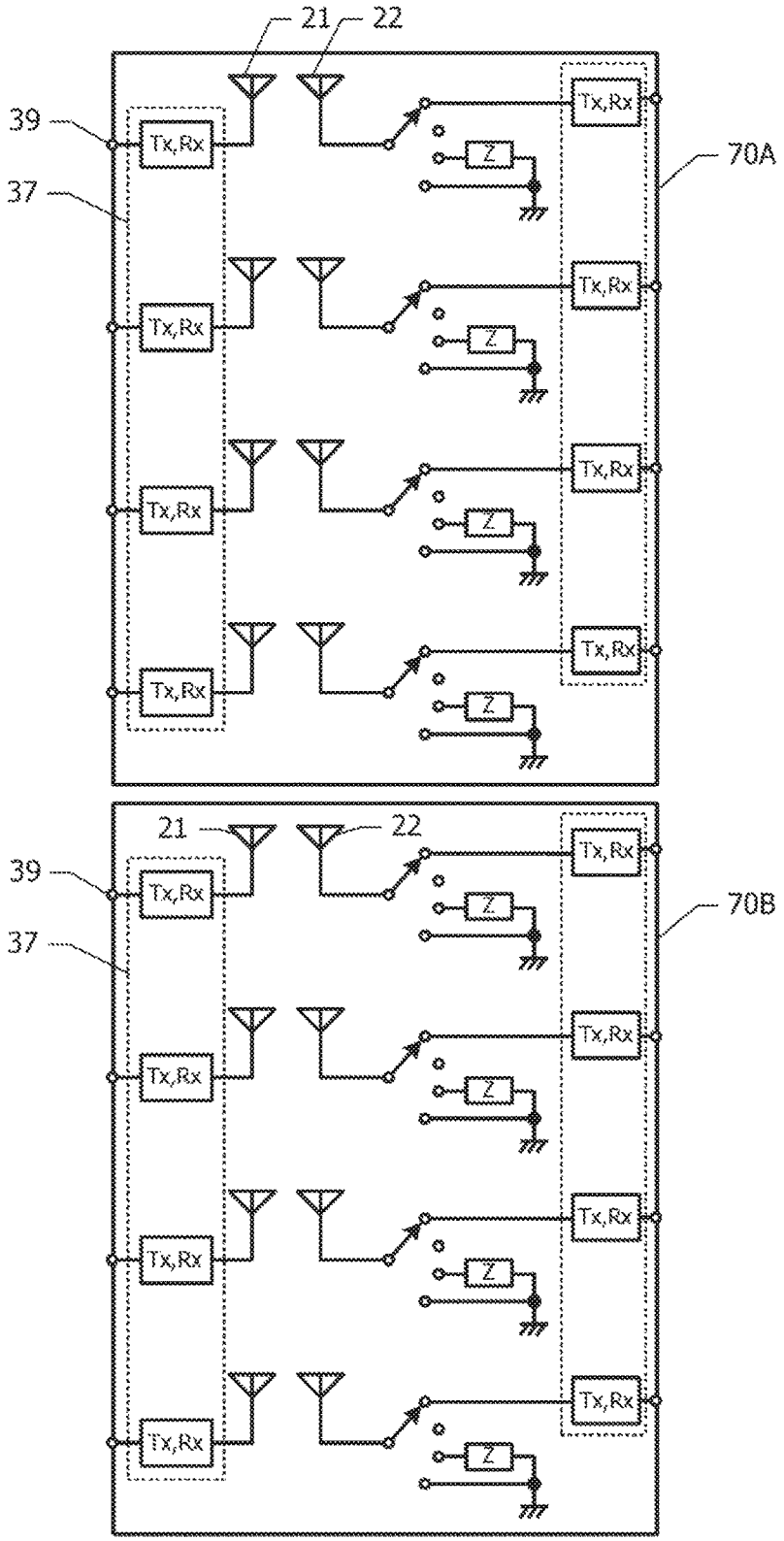
FIG. 21 is a block diagram of two multi-antenna modules installed in the mobile terminal according to the eighth embodiment.

FIG. 21 is a block diagram of the two multi-antenna modules 70A and 70B installed in the mobile terminal according to the eighth embodiment. The multiple first radiation elements 21 in one multi-antenna module 70A and the multiple first radiation elements 21 in the other multi-antenna module 70B are used as antennas for multiple-input and multiple-output (MIMO) transmission. The multiple first radiation elements 21 are connected to the first front end circuits 37. Multiple input terminals 39 are provided for the first front end circuits 37 in association with the multiple first radiation elements 21. A transmission signal is split into multiple streams and the multiple streams are input into the multiple input terminals 39 of the first front end circuits 37.

The multiple second radiation elements 22 in the multi-antenna modules 70A and 70B may be used as antennas for a diversity wireless communication method.

Advantages of the mobile terminal according to the eighth embodiment will now be described. Performing the MIMO transmission with the multiple first radiation element 21 enables the transmission capacity to be increased. Since the two multi-antenna modules 70A and 70B are arranged so as to be apart from each other in the length direction of the housing 60, the distance between the two multi-antenna modules 70A and 70B is increased. This enables the channel capacity in the MIMO transmission to be increased.

In addition, the multi-antenna modules 70A and 70B are arranged at positions that are not overlapped with the image display panel 61 in a plan view in the eighth embodiment. Accordingly, the distances from a conductor provided in the image display panel 61 to the multi-antenna modules 70A and 70B are increased. Providing the multi-antenna modules 70A and 70B at positions apart from the conductor in the image display panel 61 produces an effect in which it is difficult for the characteristics of the multi-antenna modules 70A and 70B to be affected by the image display panel 61. This effect is also produced in a case in which one multi-antenna module is arranged.

Modifications of Eighth Embodiment

Each of the multiple first radiation elements 21 in the multi-antenna modules 70A and 70B is used as an effective single element in the MIMO transmission in the eighth embodiment. Each of the multi-antenna modules 70A and 70B may be used as one effective single element. In this case, the beam forming is capable of being performed for each effective single element.

Only one multi-antenna module 70A may be arranged in the mobile terminal and the MIMO transmission may be performed with the multiple first radiation elements 21 in the multi-antenna module 70A.

A mobile terminal according to a modification of the eighth embodiment will now be described with reference to FIG. 22.

Figure 22:
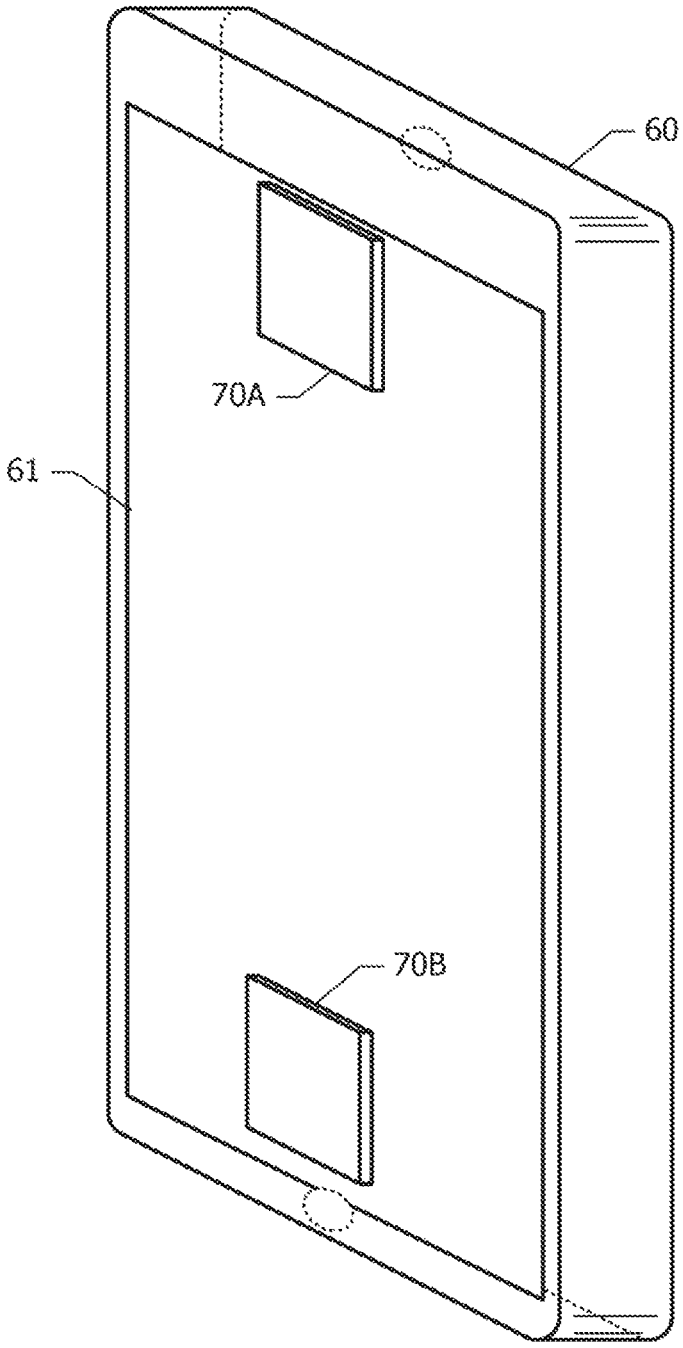
FIG. 22 is a schematic perspective view illustrating the inside of a mobile terminal according to a modification of the eighth embodiment.

FIG. 22 is a schematic perspective view illustrating the inside of the mobile terminal according to the modification of the eighth embodiment. The multi-antenna modules 70A and 70B (FIG. 20A and FIG. 20B) are arranged at a side opposite to that of the display surface of the image display panel 61 in the thickness direction of the housing 60 in the eighth embodiment. The multi-antenna modules 70A and 70B are arranged at the side of the display surface of the image display panel 61 in the present modification. The multi-antenna modules 70A and 70B are overlapped with the image display panel 61 in a plan view.

A transparent substrate is used as the dielectric substrate 20 (FIG. 1B) in order not to prevent the visibility by the multi-antenna modules 70A and 70B. In addition, the first radiation elements 21, the second radiation elements 22, the ground plane 26, the feed lines 27, and so on are made of transparent conductive materials, such as indium oxide tin. The switch element 30 (FIG. 1B) is arranged at a position that is not overlapped with the image display area of the image display panel 61. The multi-antenna modules 70A and 70B are attached to the image display panel 61 with, for example, transparent adhesive.

Making the multi-antenna modules 70A and 70B using a transparent material, as in the present modification, enables the degree of freedom of the arrangement of the multi-antenna modules 70A and 70B to be increased.

Although the configuration is adopted in the modification illustrated in FIG. 22 in which the multi-antenna modules 70A and 70B are attached to the image display panel 61, the first radiation elements 21, the second radiation elements 22, and so on may be arranged on the surface of the image display panel 61. In this case, for example, a transparent protection film on the surface of the image display panel 61 is used as the dielectric substrate 20 (FIG. 1B). The ground plane 26 (FIG. 1B) made of a transparent conductive material is arranged in the transparent protection film.

Ninth Embodiment

A mobile terminal according to a ninth embodiment will now be described with reference to FIG. 23. A description of components common to the components in the mobile terminal (FIG. 20A and FIG. 20B) according to the eighth embodiment is omitted herein.

Figure 23:
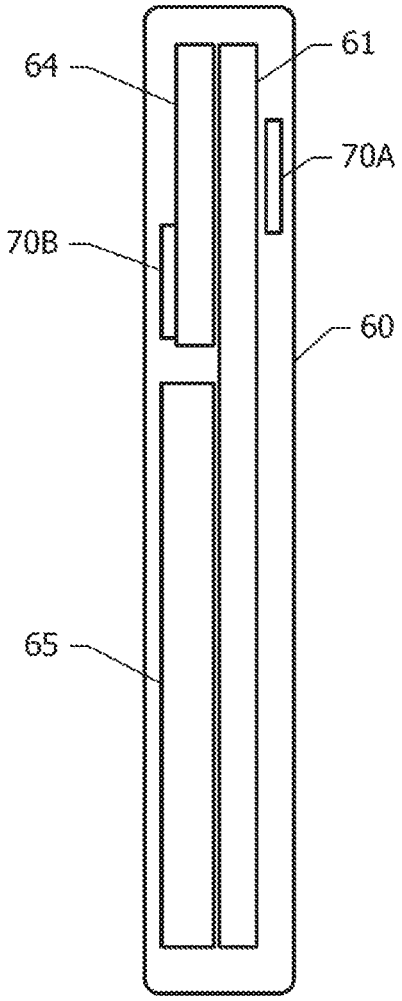
FIG. 23 is a schematic cross-sectional view of a mobile terminal according to a ninth embodiment.

FIG. 23 is a schematic cross-sectional view of the mobile terminal according to the ninth embodiment. The image display panel 61, a circuit board 64, and a battery 65 are housed in the housing 60. The circuit board 64 and the battery 65 are arranged in spaces at the rear side of the image display panel 61. The circuit board 64 and the battery 65 are overlapped with the image display panel 61 in a plan view.

The two multi-antenna modules 70A and 70B are arranged in spaces at the rear side of the image display panel 61 in the eighth embodiment (FIG. 20A and FIG. 20B). In contrast, in the ninth embodiment, the multi-antenna module 70A is arranged in a space at the front side of the image display panel 61 and the multi-antenna module 70B is arranged in a space at the rear side of the image display panel 61. The multi-antenna module 70B at the rear side is arranged at a position overlapped with the circuit board 64 in a plan view. The multi-antenna module 70A at the front side has the same configuration as that of the multi-antenna module 70A installed in the mobile terminal according to the modification (FIG. 22) of the eighth embodiment. The multi-antenna module 70B at the rear side may be surface-mounted on the circuit board 64 or may be connected to the circuit board 64 through a coaxial cable.

In the ninth embodiment, it is possible to provide strong directivity of radio waves at both the front side and the rear side of the mobile terminal.

Tenth Embodiment

A mobile terminal according to a tenth embodiment will now be described with reference to FIG. 24A. A description of components common to the components in the mobile terminal (FIG. 20A and FIG. 20B) according to the eighth embodiment is omitted herein.

Figure 24B:
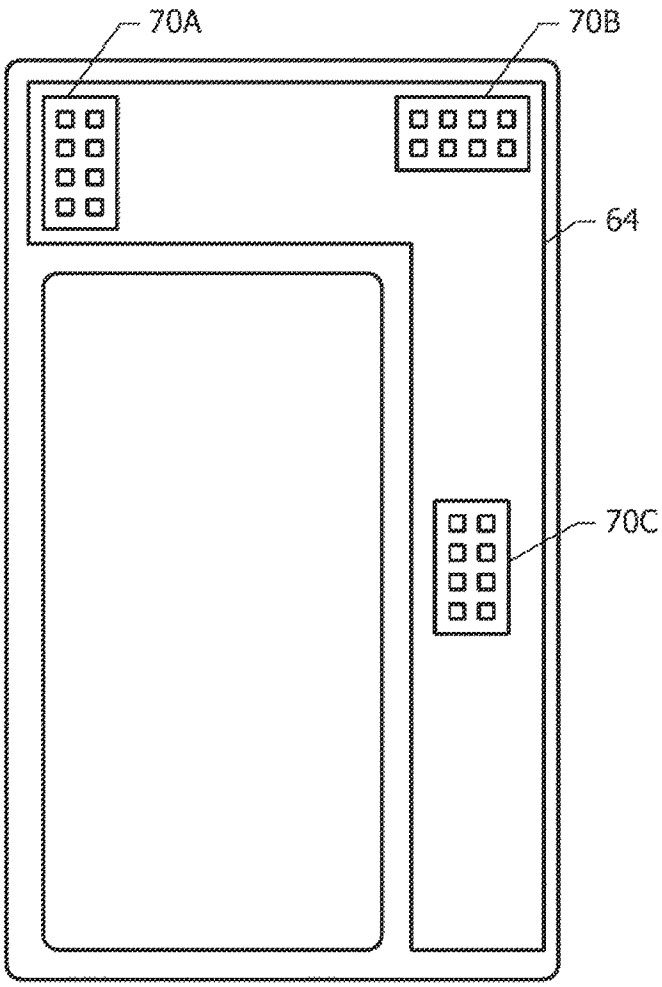
FIG. 24A is a schematic plan view illustrating the arrangement of multi-antenna modules mounted in a mobile terminal according to a tenth embodiment and FIG. 24B is a schematic plan view illustrating the arrangement of multi-antenna modules mounted in a mobile terminal according to a modification of the tenth embodiment.
Figure 24A:
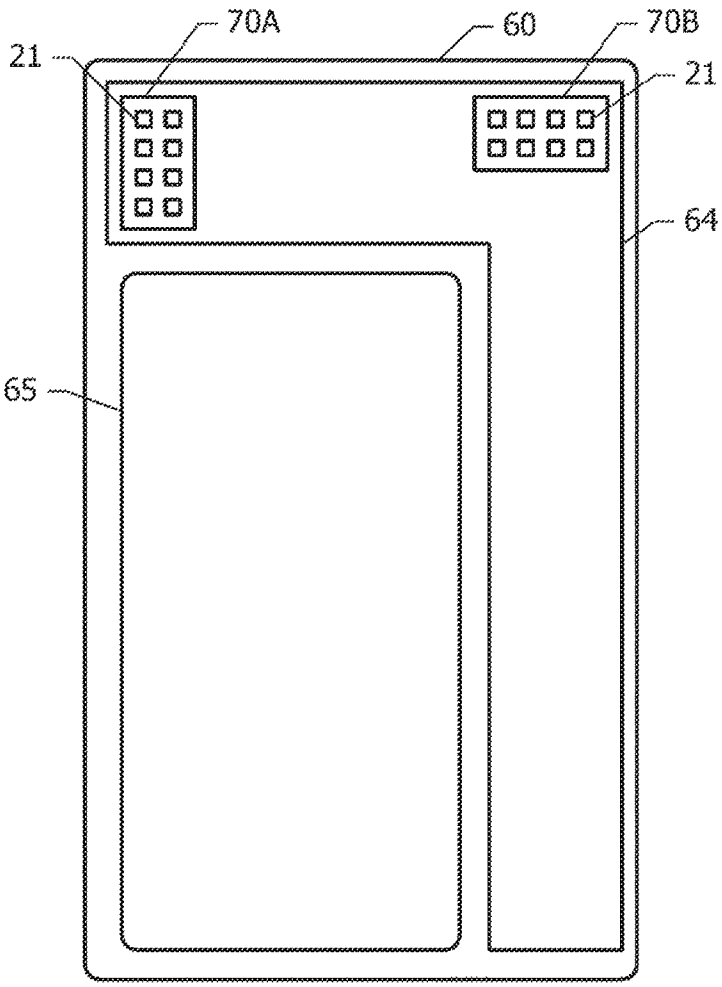

FIG. 24A is a schematic plan view illustrating the arrangement of the multi-antenna modules 70A and 70B mounted in the mobile terminal according to the tenth embodiment. The orientations of the multi-antenna modules 70A and 70B with respect to the housing 60 is not specially described in the eighth embodiment (FIG. 20A and FIG. 20B). The orientations of the multi-antenna modules 70A and 70B will be specifically described in the tenth embodiment.

The circuit board 64 and the battery 65 are arranged in the housing 60 so as not to overlap with each other. The two multi-antenna modules 70A and 70B are arranged at positions overlapped with the circuit board 64.

The dielectric substrates of the multi-antenna modules 70A and 70B installed in the mobile terminal according to the tenth embodiment have shapes having longer sides in one direction, as in the fourth embodiment (FIG. 9A, FIG. 9B, and FIG. 9C). The number of the first radiation elements 21 arranged in the longitudinal direction of the dielectric substrate is greater than the number of the first radiation elements 21 arranged in the width direction orthogonal to the longitudinal direction. In the tenth embodiment, the longitudinal direction of the multi-antenna module 70A is orthogonal to the longitudinal direction of the multi-antenna module 70B. For example, the longitudinal direction of the multi-antenna module 70A is parallel to the longitudinal direction of the housing 60 while the longitudinal direction of the multi-antenna module 70B is orthogonal to the longitudinal direction of the housing 60. The two multi-antenna modules 70A and 70B are arranged at two corners of the housing 60.

The polarization direction of radio waves radiated from the first radiation elements 21 in the multi-antenna module 70A is parallel to the polarization direction of radio waves radiated from the first radiation elements 21 in the multi-antenna module 70B. For example, in the multi-antenna module 70A, the polarization direction of the radio waves radiated from the first radiation elements 21 is parallel to the longitudinal direction of the multi-antenna module 70A. In the multi-antenna module 70B, the polarization direction of the radio waves radiated from the first radiation elements 21 is orthogonal to the longitudinal direction of the multi-antenna module 70B.

Making the polarization directions of the two multi-antenna modules 70A and 70B parallel to each other enables the two multi-antenna modules 70A and 70B to be used as antennas for the MIMO transmission. As described above, also in the configuration in which the two multi-antenna modules 70A and 70B are arranged so that the longitudinal directions of the multi-antenna modules 70A and 70B are orthogonal to each other, the MIMO transmission is capable of being realized.

Modifications of Tenth Embodiment

Modifications of the tenth embodiment will now be described.

The multi-antenna module the polarization direction of which is parallel to the longitudinal direction thereof and the multi-antenna module the polarization direction of which is orthogonal to the longitudinal direction thereof are installed in the mobile terminal according to the tenth embodiment. Two polarization modes: a mode in which polarized waves parallel to the longitudinal direction are transmitted and received and a mode in which polarized waves orthogonal to the longitudinal direction are transmitted and received may be set in one multi-antenna module. For example, two feeding points that are excited in directions that are orthogonal to each other may be provided for each of the first radiation elements 21 and power may be selectively applied to one feeding point. Setting the two polarization modes for the multi-antenna module enables the multi-antenna modules having the same structure (the same type) to be used as the two multi-antenna modules 70A and 70B.

The polarization direction of the multi-antenna module 70A may be orthogonal to the polarization direction of the multi-antenna module 70B. The use of the polarization directions that are orthogonal to each other enables a polarization diversity communication method to be realized.

FIG. 24B is a schematic plan view of a mobile terminal according to another modification of the tenth embodiment. In the present modification, in addition to the multi-antenna modules 70A and 70B, a third multi-antenna module 70C is arranged at a position overlapped with the circuit board 64. The longitudinal direction of the multi-antenna module 70C is parallel to, for example, the longitudinal direction of the multi-antenna module 70A. The installation of the three multi-antenna modules 70A, 70B, and 70C enables the transmission speed in the MIMO transmission to be increased. The multi-antenna modules 70A, 70B, and 70C operate in synchronization with each other.

Figure 25:
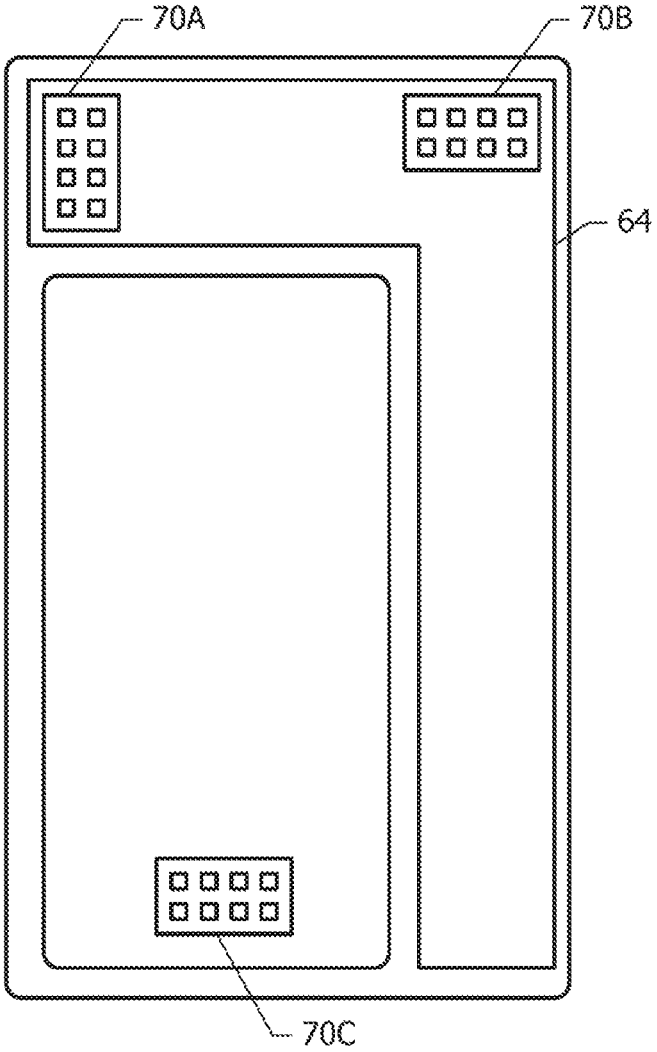
FIG. 25 is a schematic plan view illustrating the arrangement of multi-antenna modules mounted in a mobile terminal according to another modification of the tenth embodiment.

FIG. 25 is a schematic plan view of a mobile terminal according to another modification of the tenth embodiment. In the present modification, the multi-antenna modules 70A and 70B are arranged at positions overlapped with the circuit board 64 and the multi-antenna module 70C is arranged at a position overlapped with the battery 65. Arranging the multi-antenna module 70C at a position overlapped with the battery 65 enables the degree of freedom of the position where the multi-antenna module is installed to be increased. The multi-antenna module 70C is connected to the circuit board 64 through a flexible substrate or a cable (not illustrated) and operates in synchronization with the multi-antenna modules 70A and 70B.

The above embodiments are only examples and partial replacement or combination of the components described in different embodiments is available. Similar effects and advantages of similar components in multiple embodiments are not sequentially described for the respective embodiments. In addition, the present disclosure is not limited to the above embodiments. For example, it will be understood by those skilled in the art that various changes, modifications, combinations, and so on may be made.

While embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A multi-antenna module comprising:

a dielectric substrate;

a first radiation element that is provided on or in the dielectric substrate;

a second radiation element that is provided on or in the dielectric substrate and that operates at a frequency band lower than that of the first radiation element;

a ground plane that is provided on or in the dielectric substrate;

a first feed line that is provided on or in the dielectric substrate and that supplies power to the first radiation element;

a second feed line that is provided on or in the dielectric substrate and that supplies power to the second radiation element; and a first switch configured to switch the multi-antenna module between a first state and a second state, wherein when the multi-antenna module is in the first state, the first switch is configured such that a first signal is supplied to the second radiation element through the second feed line, and wherein when the multi-antenna module is in the second state, the first switch is configured such that the second radiation element is connected to the ground plane with a terminal impedance interposed between the second radiation element and the ground plane, the second radiation element is in a floating state with respect to the second feed line and the ground plane, or the second radiation element is short-circuited to the ground plane.

2. The multi-antenna module according to claim 1, wherein the terminal impedance comprises at least one of a resistance component having a fixed resistance, an inductance component having a fixed inductance, and a capacitance component having a fixed capacitance.

3. The multi-antenna module according to claim 1, wherein the terminal impedance is matched with an input impedance of the second radiation element.

4. The multi-antenna module according to claim 3, wherein the terminal impedance has a value of 50Ω.

5. The multi-antenna module according to claim 1, further comprising:

a second switch configured to switch the multi-antenna module between a third state and a fourth state, wherein when the multi-antenna module is in the third state, the second switch is configured such that a second signal is supplied to the first radiation element through the first feed line, and wherein when the multi-antenna module is in the fourth state, the second switch is configured such that the first radiation element is connected to the ground plane with a second terminal impedance interposed therebetween, the first radiation element is in a floating state with respect to the first feed line and the ground plane, or the first radiation element is short-circuited to the ground plane.

6. The multi-antenna module according to claim 1, wherein the dielectric substrate is flexible.

7. The multi-antenna module according to claim 1, wherein the first radiation element is arranged on a first face of the dielectric substrate, and the multi-antenna module further comprises:

a first front end circuit and a transmission-reception circuit that are connected to the first radiation element and that are mounted on a second face of the dielectric substrate or in the dielectric substrate, the second face being opposite to the first face.

8. The multi-antenna module according to claim 7, further comprising:

a second front end circuit that is connected to the second radiation element and that is mounted on the second face of the dielectric substrate or in the dielectric substrate.

9. The multi-antenna module according to claim 8, wherein the second front end circuit comprises a power amplifier configured to amplify a transmission signal supplied to the second radiation element.

10. The multi-antenna module according to claim 9, wherein the second front end circuit comprises an isolator connected to an output of the power amplifier.

11. The multi-antenna module according to claim 1, wherein the first radiation element and the ground plane form a patch antenna operating in a 28-MHz band or in a millimeter-wave band, and wherein the second radiation element operates in a frequency band of 6 GHz or less.

12. A mobile terminal comprising:

an image display panel; and a first multi-antenna module arranged at a position that overlaps the image display panel, wherein the first multi-antenna module comprises:

a dielectric substrate;

a first radiation element that is provided on or in the dielectric substrate;

a second radiation element that is provided on or in the dielectric substrate and that operates at a frequency band lower than that of the first radiation element;

a ground plane that is provided on or in the dielectric substrate;

a first feed line that is provided on or in the dielectric substrate and that supplies power to the first radiation element;

a second feed line that is provided on or in the dielectric substrate and that supplies power to the second radiation element; and a first switch configured to switch the multi-antenna module between a first state and a second state, wherein when the multi-antenna module is in the first state, the first switch is configured such that a first signal is supplied to the second radiation element through the second feed line, and wherein when the multi-antenna module is in the second state, the first switch is configured such that the second radiation element is connected to the ground plane with a terminal impedance interposed between the second radiation element and the ground plane, the second radiation element is in a floating state with respect to the second feed line and the ground plane, or the second radiation element is short-circuited to the ground plane.

13. The mobile terminal according to claim 12, wherein the dielectric substrate is a transparent substrate arranged at a side of a display surface of the image display panel, and wherein the first radiation element, the second radiation element, the ground plane, the first feed line, and the second feed line are made of transparent conductive materials.

14. A mobile terminal comprising:

an image display panel;

a first multi-antenna module; and a second multi-antenna module, wherein the first multi-antenna module and the second multi-antenna module each comprise:

a dielectric substrate;

a first radiation element that is provided on or in the dielectric substrate;

a second radiation element that is provided on or in the dielectric substrate and that operates at a frequency band lower than that of the first radiation element;

a ground plane that is provided on or in the dielectric substrate;

a first feed line that is provided on or in the dielectric substrate and that supplies power to the first radiation element;

a second feed line that is provided on or in the dielectric substrate and that supplies power to the second radiation element; and a first switch configured to switch the multi-antenna module between a first state and a second state, wherein when the multi-antenna module is in the first state, the first switch is configured such that a first signal is supplied to the second radiation element through the second feed line, and wherein when the multi-antenna module is in the second state, the first switch is configured such that the second radiation element is connected to the ground plane with a terminal impedance interposed between the second radiation element and the ground plane, the second radiation element is in a floating state with respect to the second feed line and the ground plane, or the second radiation element is short-circuited to the ground plane, wherein the first multi-antenna module and the second multi-antenna module are arranged so as to be apart from each other in a first dimension of the image display panel, the first dimension being the largest dimension of the image display panel.

15. The mobile terminal according to claim 14, wherein the first multi-antenna module does not overlap the image display panel in the first dimension.

* * * * *